US006463775B1

(12) United States Patent
Kodama et al.

(10) Patent No.: US 6,463,775 B1
(45) Date of Patent: Oct. 15, 2002

(54) METHOD AND APPARATUS FOR DETECTING CHATTERING IN COLD ROLLING MILL

(75) Inventors: Toshifumi Kodama, Chiba (JP); Akira Torao, Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/720,306

(22) PCT Filed: May 26, 2000

(86) PCT No.: PCT/JP00/03393

§ 371 (c)(1),
(2), (4) Date: Dec. 26, 2000

(87) PCT Pub. No.: WO00/72989

PCT Pub. Date: Dec. 7, 2000

(30) Foreign Application Priority Data

May 27, 1999 (JP) ..... 11-148312
Jan. 14, 2000 (JP) ..... 2000-005677
Apr. 12, 2000 (JP) ..... 2000-110191

(51) Int. Cl.[7] ..... B21B 37/58

(52) U.S. Cl. ..... 72/13.4; 72/8.3; 72/10.1; 72/10.8; 72/11.1

(58) Field of Search ..... 72/10.1, 10.8, 72/13.4, 237, 8.3, 8.6, 11.1, 11.2

(56) References Cited

U.S. PATENT DOCUMENTS 4,538,463 A * 9/1985 Pease ..... 73/587
4,927,299 A * 5/1990 Ramalingam et al. ..... 407/120
5,299,478 A * 4/1994 Schorn et al. ..... 83/13
5,448,902 A * 9/1995 Thoms et al. ..... 72/41
5,515,731 A * 5/1996 Weisshaar et al. ..... 72/241.4
5,724,836 A * 3/1998 Wang et al. ..... 72/13.4

FOREIGN PATENT DOCUMENTS

| | | | | |
|---|---|---|---|---|
| JP | 52-2708 | | 1/1977 | |
| JP | 60-137512 | * | 7/1985 | ..... 72/11.1 |
| JP | 5-87325 | | 4/1993 | |
| JP | 6-35004 | | 2/1994 | |
| JP | 7-12638 | * | 1/1995 | ..... B21C/47/02 |
| JP | 8-108205 | | 4/1996 | |
| JP | 8-141612 | | 6/1996 | |
| NL | 8105608 | * | 7/1983 | ..... 72/8.6 |

OTHER PUBLICATIONS

Suzuki, "Atsuen Hyakuwa", *Kikai no Kenkyu* 1996, vol. 48, No. 5, pp. 583–588.

"Analysis of chattering phenonmenon in cold rolling", *Proc. Intl Conf on Steel Rolling,* 1980, vol. 2.

* cited by examiner

*Primary Examiner*—Ed Tolan
(74) *Attorney, Agent, or Firm*—Oliff & Berridge, PLC

(57) ABSTRACT

The present invention relates to a method for detecting chattering of a cold rolling mill rapidly and accurately, which occurs during cold rolling of a steel strips. The occurrence of the chattering is detected by a plurality of acoustic parameters derived from a sound measured in the vicinity of the cold rolling mill during the rolling. The acoustic parameters are the frequency range characteristic of the occurrence of the chattering, the acoustic intensities in the frequency bands which are n-th harmonics, the peak frequency of the acoustic frequency component distribution, the resonance factor, the peak intensity, and the like. A plurality of parameters may be provided by measuring and calculating the same parameter with different timing.

15 Claims, 24 Drawing Sheets

METHOD AND APPARATUS FOR DETECTING CHATTERING IN COLD ROLLING MILL

TECHNICAL FIELD

The present invention relates to methods and apparatuses for detecting chattering in cold rolling mills. In particular, the present invention relates to a method and an apparatus suitable for detecting chattering, which occurs during cold rolling of a steel strips in a cold rolling mill.

BACKGROUND ART

It has been conventionally known that a vibration phenomenon of a rolling mill called chattering occurs in some cases during cold rolling of a strip (for example "Atsuen Hyakuwa" (various stories about rolling) by Suzuki in "Kikai no Kenkyu (Studies of Machines)" published by Yokendo, Vol. 48, No. 5, pp. 583–588). When the amplitude of the vibration is small, lateral stripes formed at a certain pitch in a direction perpendicular to the rolling direction are merely observed on both front and back sides of the rolled strip. When the amplitude of the vibration is large, however, the thickness of the rolled sheet periodically varies. In the case of a significant variation in the thickness, the minimum thickness of the strip becomes even a half or less of the maximum thickness. When the amplitude of the vibration is more significant, the rapture of the strip may occur due to a further increased variation in the thickness.

FIG. 1 shows an example of observed thickness offset ($\Delta t$) of a cold-rolled strip which is rolled when chattering occurred. Periodical thickness variations occur in the longitudinal direction (L) of rolling. Among portions having such thickness variations, segments (hatched portions in the drawing) outside the tolerance limit are discarded as failure portions in the subsequent step or in an intermediate step before the product is shipped. That is, a decrease in yield and an extra maintenance operation may cause deterioration of production cost.

When the rupture of the strip occurs, the rolling line must be unavoidably stopped for a long time, resulting in significant deterioration of production efficiency.

Thus, the detection of the chattering phenomena is important. In many cases of chattering, initial vibrations with small amplitudes develop into vibrations with larger amplitudes within 2 to 3 seconds. Thus, in daily operations, the initiation of the chattering must be highly sensitively and rapidly detected to perform any countermeasure, for example, deceleration of the rolling speed.

Various methods and apparatuses have been proposed for detecting chattering.

For example, Japanese Examined Patent Application Publication No. 5-87325 discloses a method for detecting the occurrence of chattering when a difference in the thicknesses which are simultaneously observed at two or more points in the longitudinal direction of the material to be rolled exceeds a predetermined value. The measurement of the thickness is performed at an interval which is substantially the half the pitch of the generated variation in the thickness. Herein, it is known that the variation in the thickness of the rolled strip due to chattering during cold rolling is 1 to several $\mu$m and the period of the variation is several tens of msec. Thus, the thicknessmeter must have high detecting resolution and a short response time. Thicknessmeters satisfying these two requirements are considerably expensive. According to this method, two radiation thicknessmeters being expensive apparatuses must be proximately installed at a position for originally installing one apparatus. Thus this method has a problem of increased facility cost.

Japanese Unexamined Patent Application Publication No. 8-141612 discloses a method for detecting chattering using detecting signals from a vibration sensor provided in a rolling mill. The detecting signals are processed using a filter having transmission characteristics which are set based on each operational condition of the rolling mill.

Japanese Examined Patent Application Publication No. 6-35004 discloses a method for detecting chattering using signals obtained by filtering the output from a vibration velocity sensor which is mounted in a housing of a cold rolling mill. The filter transmits only vibrations in a natural frequency range of the rolling mill.

Japanese Unexamined Patent Application Publication No. 8-108205 discloses a method in which vibration parameters of the rolling mill based on the observed data and rolling parameters of the rolling mill are subjected to a frequency analysis. When a frequency component which is an integer multiple of the fundamental frequency exceeds a predetermined value, the occurrence of chattering is determined. The vibration parameters of the rolling mill are detected during the operation using vibration detectors which are installed at least at one position of the rolling mill. The vibration parameters, which are detected and analyzed, are a vibration displacement, a vibration velocity, and vibration acceleration at each position. The rolling parameters are a tension, a rolling torque, and a rolling speed of the rolling mill. The fundamental frequency is obtained by calculating the natural frequency of the mill, and inherent vibration frequencies which are generated by interlocking of gears, failure of a bearing, unsuccessful coupling between a spindle and a roll, and flaws of a roll.

In any of the above conventional technologies, the detection of chattering is performed based on detected signals from vibration sensors at one or more positions of the rolling mills. These sensors, however, detect the vibrations due to the mechanisms of the rolling mill, in addition to the vibrations due to the chattering. That is, when the frequency components of vibrations of the mechanisms of the rolling mill include in the frequency range for the frequency components of the chattering, erroneous detection of the chattering occurs.

In the conventional technologies, outputs from a plurality of vibration sensors and the frequencies of the rolling parameters must be analyzed at high speeds. Thus, the scale and the cost of the apparatus are unavoidably increased. Moreover, the vibration based on the abnormal mechanical system in the rolling mill and the vibrations of the resulting rolling parameters are merely requirements regarding the factors for generating the chattering. Thus, the occurrence of chattering due to other factors may be missed. On the other hand, an abnormal mechanical system before chattering or vibrations of the rolling parameters may lead erroneous detection of chattering. As a countermeasure against this problem, for example, Japanese Unexamined Patent Application Publication No. 8-108205 discloses a method for momentarily analyzing or calculating the frequencies based on the vibrations of individual components and the outputs of the rolling parameters of the rolling machine and the theoretical vibration based on the abnormal mechanical system. In this method, however, a vibration sensor must be installed in a mill housing or in the vicinity thereof. In this case, the vibration sensor is placed in adverse environments, for example, oil in the mill and roll-cooling water. Such adverse environments result in severe deterioration of the vibration sensor and the replacement of the vibration sensor is a bother.

On the other hand, the applicant proposed a method by an acoustic measurement, which is different from the above methods, in Japanese Unexamined Patent Application Publication No. 60-137512.

In general, vibration of a substance vibrates the air in the vicinity thereof and propagates the vibration as sound. The acoustic measurement is generally performed by detecting the pressure fluctuation of the air at a predetermined position. An acoustic sensor detects and signalizes this pressure fluctuation and the resulting signals are acoustic signals. A microphone is a typical acoustic sensor and outputs the acoustic signals as electrical signals. The sound has frequency components whereas the acoustic sensor exhibits frequency characteristics, such as a detectable frequency range and frequency-dependent sensitivity. Thus, the acoustic signals change depending on the acoustic sensor used. The time variation of the acoustic signals forms an acoustic waveform. The acoustic waveform contains high-frequency vibration components having short periods. Acoustic signals after eliminating the high-frequency vibration components are specially called sound intensity, which is often used as a parameter representing acoustic characteristics. The high-frequency vibration components are eliminated by, for example, calculating the effective value of the acoustic signal (for example, square integrated value within a given time interval) or a peak amplitude of the acoustic signal within a given time interval. Various values derived from the acoustic measurement such as the acoustic intensity are acoustic parameters.

The above proposal discloses a method in which a tone inherent in the chattering during rolling of the cold rolling mill is converted into an electrical signal and the occurrence of the chattering is detected when the magnitude of the electrical signal exceeds a predetermined value. The first embodiment of this method is shown in FIG. 2. During rolling a material 8 to be rolled, tones in the vicinity of individual rolling stands 11 in a tandem cold rolling mill 10 are converted into electrical signals using a microphone 14 as an acoustic sensor. The electrical signals enter a band pass filter 22 so as to transmit only signals in a chattering frequency range. The outputs from the band pass filter are rectified for a predetermined time interval to output an integrated value. The integrated value is input into a comparator circuit (CMP) 29. If the input signal exceeds a predetermined value, the comparator circuit generates a chattering-detecting signal. The detecting signal is input into a driving circuit 31 to operate an acoustic apparatus 32. Moreover, another embodiment is shown in FIG. 3. The microphone 14, the comparator circuit 29 outputting the chattering-occurrence signals when the input signal exceeds the predetermined value, and the subsequences are substantially the same as those in the first embodiment. The electrical signals from the microphone are analyzed in a frequency analysis circuit (FA) 42, and the output from the frequency analysis circuit enters a band pass filter 22 to extract frequency components inherent in the chattering. The output signal from the band pass filter is input into the comparator circuit 29.

In this method, no acoustic sensor is placed in the mill housing, and the number of the sensor is one. Thus, this method has an advantage of easy maintenance compared to the use of the vibration sensor.

When a noise containing frequency components similar to those of the chattering is generated at other places in the rolling plant, erroneous detection of the chattering tends to occur, because a signal is distinguished only by the frequency components from the sound detected by the acoustic sensor.

In the first embodiment of Japanese Unexamined Patent Application Publication No. 60-137512, the output waveform is still an AC waveform. Even if the waveform is integrated for a given time interval, the integrated value becomes substantially zero. Thus, this method cannot detect a phenomenon of increasing amplitude of the frequency components inherent in the chattering. In the second embodiment, the frequency analysis circuit generally does not have a function for outputting waveform signals, and thus, it is difficult to obtain information on the occurrence of chattering from the band pass filter.

The standard for judgement in the conventional technologies is to detect whether or not the frequency components inherent in the occurrence of the chattering is are contained in the observed vibration waveform or the observed acoustic waveform. The present inventors have discovered by long-term intensive experiments at operation sites that impulsive vibrational phenomena generated at the interior and the exterior of the rolling mill are also detected together with the vibrational phenomenon generated by rolling when the vibration waveform and the acoustic waveform are measured in the vicinity of the rolling mill during the rolling operation. Since these impulsive vibrations generally contain frequency components ranging from low frequencies to high frequencies, these impulsive vibrations are erroneously detected as chattering in some cases in the conventional technologies.

The inventors have intensively repeated the measurements in the production sites and have discovered that one of such noise phenomena is pulsed sound. This impulsive vibrational state is shown in FIG. 4. FIG. 4(*a*) shows a time variation of an acoustic signal (A) in an acoustic waveform which is observed in the vicinity of the cold rolling mill, wherein the acoustic signal depends on the properties of the acoustic sensor used and has an arbitrary unit. FIG. 4(*b*) shows a time variation of an output ($V_B$) from the band pass filter containing only the frequency components inherent in the chattering, based on the input of the acoustic signal. FIG. 4(*c*) shows a time variation of a rectified value ($V_A$) of the output from the band pass filter. FIG. 4(*d*) shows a time variation of the output ($V_C$) from a comparator device which submits an alarm output when the rectified waveform exceeds a threshold value, and FIG. 4(*e*) shows a time variation of the velocity (v) of the material to be rolled. FIG. 4(*a*) includes pulses at positions indicated by arrows, and the pulses sound alarms, as shown in FIG. 4(*d*). However, as shown in FIG. 4(*e*), the rolling velocity does not change. That is, the rolling state is normal without chattering. Accordingly, when a pulsed acoustic wave occurs, the conventional apparatus sounds an alarm regardless of a normal rolling state.

In order to eliminate such a pulsed waveform as noise, a method for smoothing by the moving average of the amplitude of the waveform has been conventionally used. When the time interval for the moving average is larger than the duration width of the pulsed noise, the peak value of the noise is reduced in response thereto. However, a large width of the moving average causes a delayed response time in detection of the occurrence of the chattering, although the noise is reduced. That is, the occurrence of the chattering cannot be rapidly detected. As a result, the operation action tends to be delayed, resulting in increased chattering failures. Moreover, the operational treatment is not in time, and the rolled material may be ruptured.

Accordingly, no method for exactly and rapidly detecting the occurrence of the chattering has been established.

DISCLOSURE OF INVENTION

The present invention has been accomplished in order to establish a method for detecting the occurrence of chattering exactly and rapidly. That is, an object is to detect the occurrence of chattering during the cold rolling operation correctly using a simple configuration, without effects of noise due to factors other than the rolling operation and impulsive vibration applied to facilities including rolling mills and auxiliary rolls between stands.

Accordingly, the present invention relates to a method for detecting chattering of a cold rolling mill using a plurality of acoustic parameters derived from a sound measured in the vicinity of the cold rolling mill during rolling. The acoustic parameters are as follows; Acoustic intensities of a frequency range characteristic of the occurrence of chattering and frequency ranges of N-th harmonic (frequency ranges having upper and lower limits corresponding to N times of the upper and lower limit of, the frequency range characteristic of the occurrence of chattering), the peak frequency in the acoustic frequency component distribution, the resonance factor, and the peak intensity. The same parameter may be measured and calculated at different types of timing as a plurality of parameters. Also, the present invention relates to an acoustic sensor, a circuit for calculating a plurality of acoustic parameters from acoustic signals in the sensor output, and an apparatus for detecting chattering of a cold rolling mill using the plurality of acoustic parameters and for submitting a signal.

An example of the acoustic waveform observed when the chattering occurs is shown in FIG. 5. It is well known that the acoustic waveform is nearly equal to a sine wave when the time axis is enlarged. In the same observation, a frequency component distribution of an acoustic signal at a certain time is shown FIG. 6. The acoustic signal component at a certain frequency is represented by $A_f$ having an arbitrary unit. Peaks are intensively observed in the vicinity of certain frequencies. According to the description by T. Tamiya et al.: "Analysis of chattering phenomenon in cold rolling" (Proc., Intl., Conf., on Steel Rolling, 1980, Vol. 2), the chattering phenomenon is explained as a resonance phenomenon of a coupled vibration system of a rolling mill frame and a rolling roll. When the sound due to vibration of the rolling mill is observed at a time of the occurrence of the chattering, peaks appear in a narrow band in the vicinity of the chattering frequency in the frequency distribution of the acoustic signal. The acoustic signal in regions other than the chattering frequency is small.

In contrast, an example of an acoustic waveform containing impulsive vibration occurring at the interior and the exterior of the rolling mill is shown in FIG. 7. A frequency component distribution of an acoustic signal at a certain time in the same measurement is shown in FIG. 8. In FIG. 8, peaks are observed over a wide range, unlike in FIG. 6. The acoustic signal other than the peak frequency is substantially the same level. When an acoustic signal which is larger than a predetermined value is detected, one due to chattering and one due to others such as an impulsive sound can be discriminated. Thus, only the occurrence of the chattering can be detected.

For example, the waveform discrimination can be quantified with a resonance factor Q. FIG. 9 exhibits a frequency component distribution of an acoustic signal. The peak frequency at the maximum acoustic signal frequency component is set to be $f_0$, and frequencies having an acoustic signal frequency component of $1/\sqrt{2}$ at the upper and lower sides of the peak frequency are set to be $f_l$ and $f_h$. The resonance factor Q is defined as follows:

$$Q=f_0/(f_h-f_1) \quad (1)$$

The sharpness of the sound resonance can be quantified by the resonance factor Q. This value can detect the occurrence of the chattering.

The present invention is based on this principle.

BEST MODE FOR CARRYING OUT THE INVENTION

The embodiments in accordance with the present invention will now be described in detail with reference to the drawings.

Figure 1:
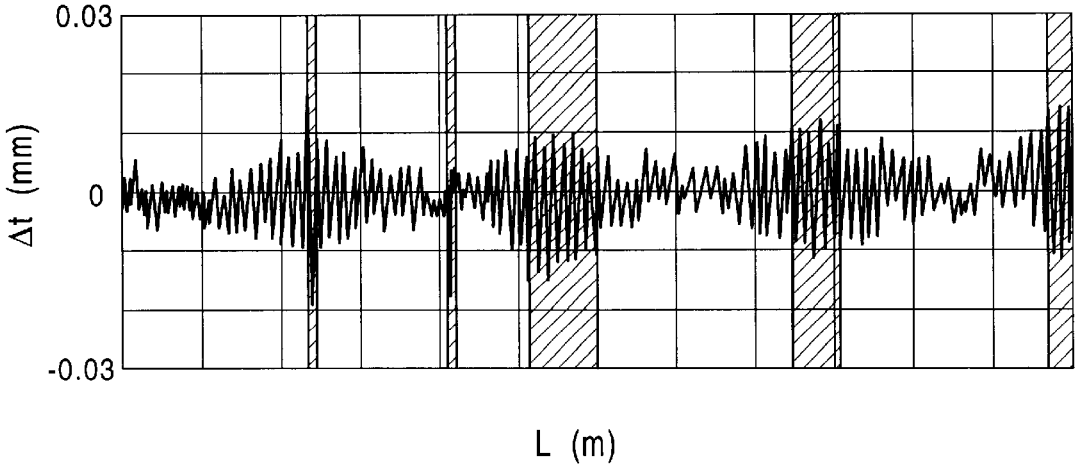
FIG. 1 is an example of the thickness offset in the longitudinal direction of a rolled material when chattering occurs.
Figure 2:
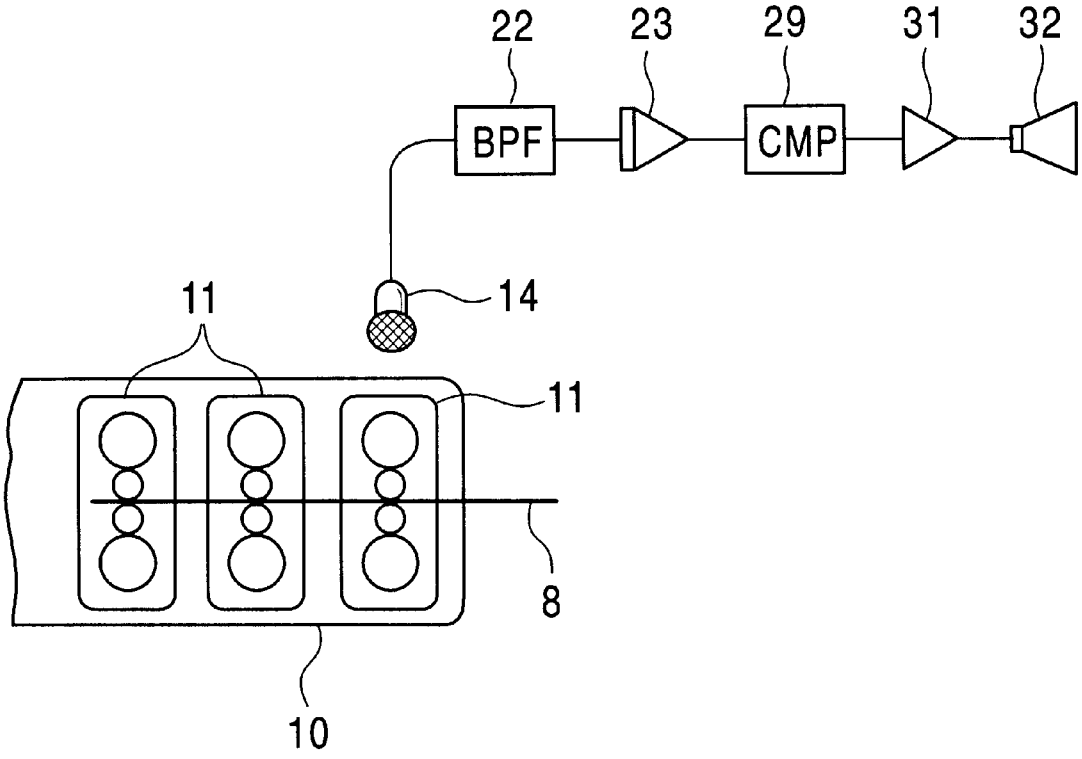
FIG. 2 is a block diagram of a configuration of a first embodiment of Japanese Unexamined Patent Application Publication No. 60-137512.
Figure 3:
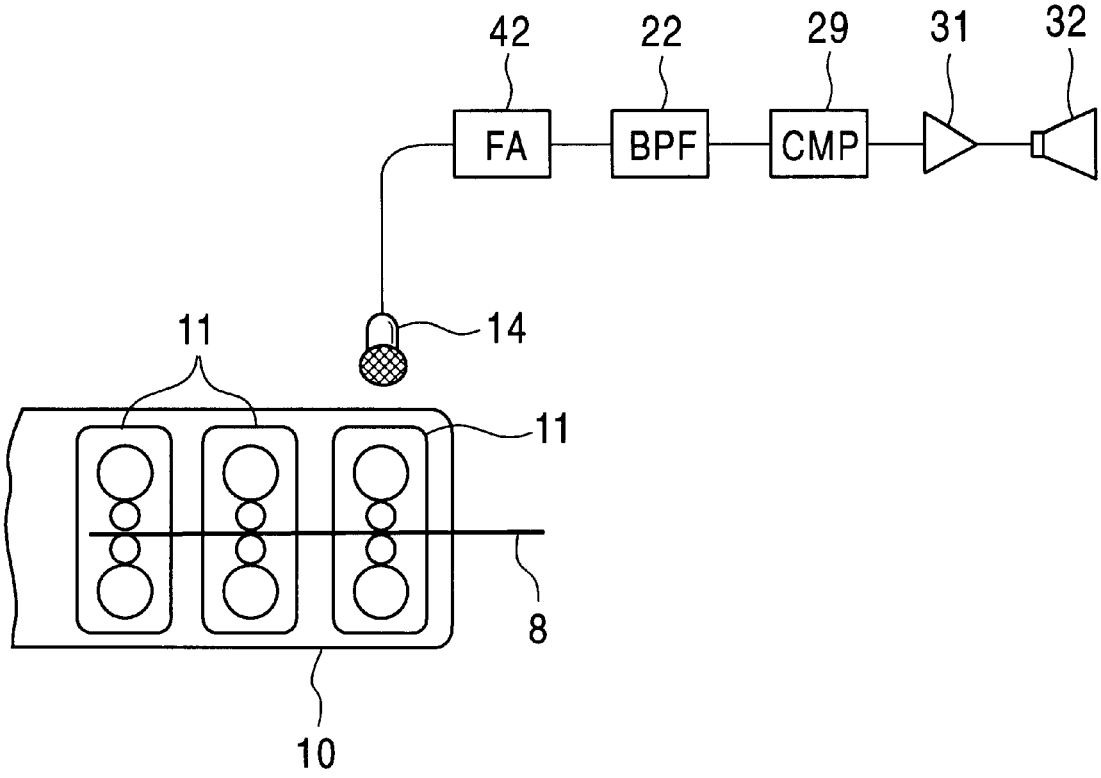
FIG. 3 is a block diagram of a configuration of a second embodiment of Japanese Unexamined Patent Application Publication No. 60-137512.
Figure 4:
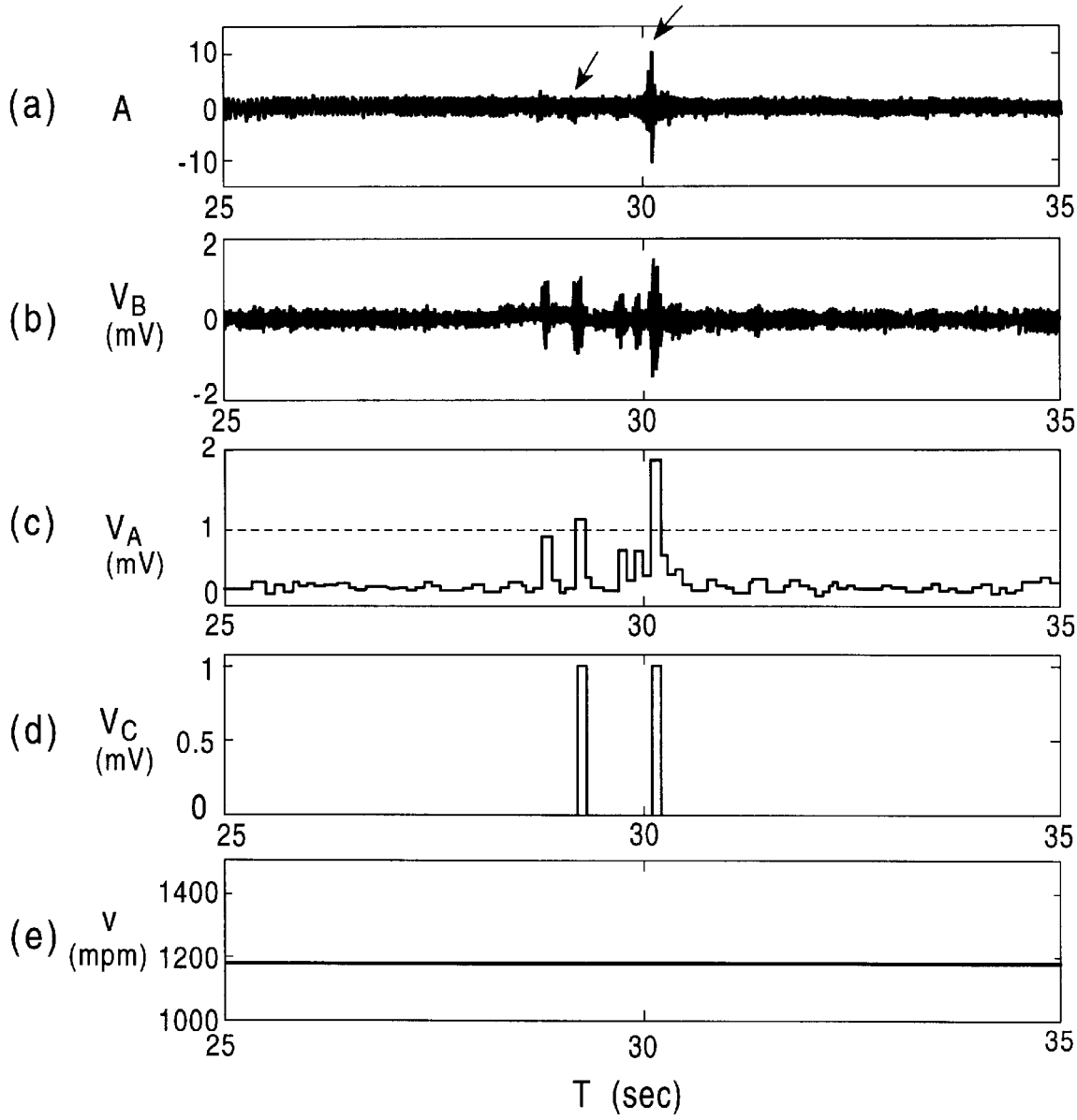
FIG. 4 includes graphs showing time variations of individual signals when the impulsive signal is misinterpreted as that due to chattering in a method similar to a conventional method.
Figure 5:
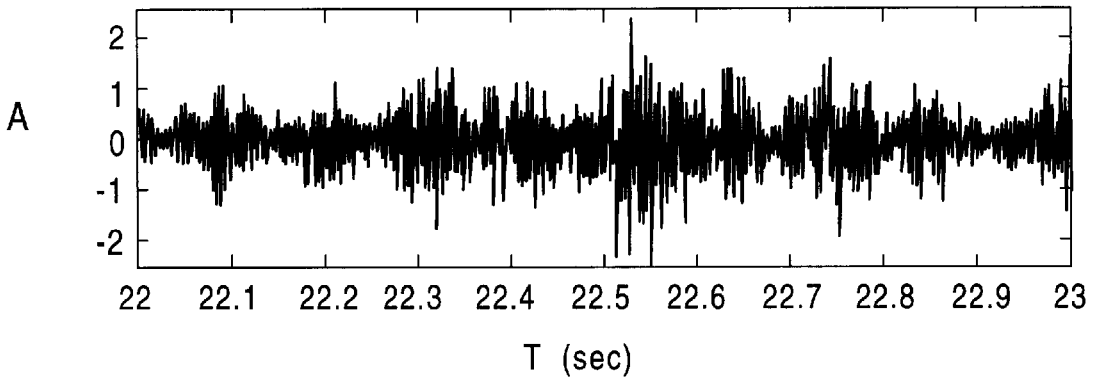
FIG. 5 is a graph showing an example of an acoustic waveform when chattering occurs.
Figure 6:
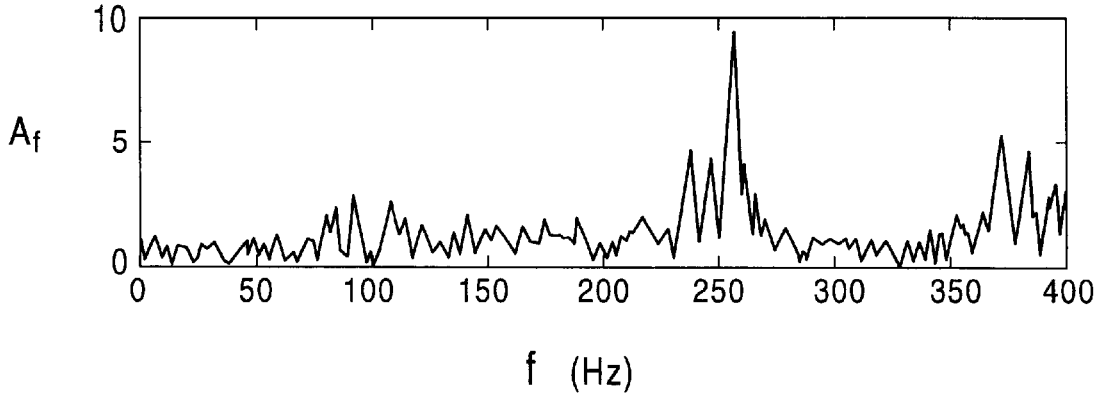
FIG. 6 is a graph showing a frequency component distribution of the acoustic signal shown in FIG. 5.
Figure 7:
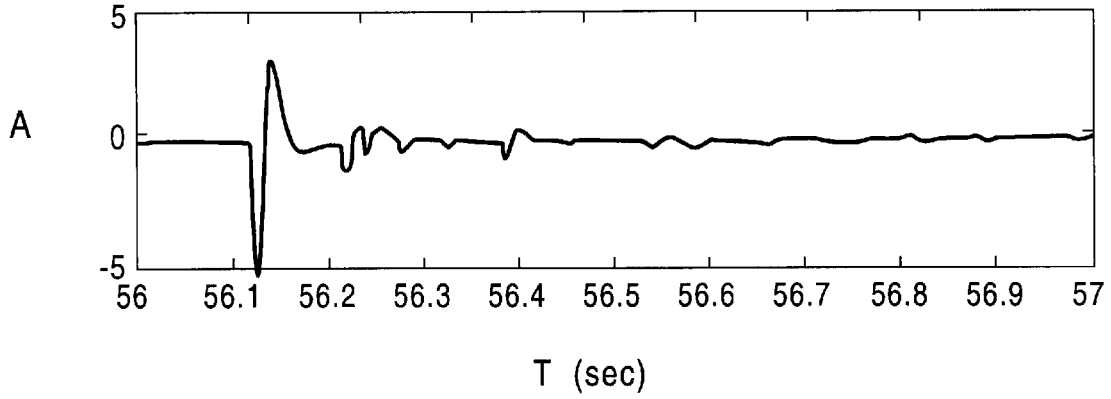
FIG. 7 is a graph showing an example of an acoustic waveform containing impulsive sound.
Figure 8:
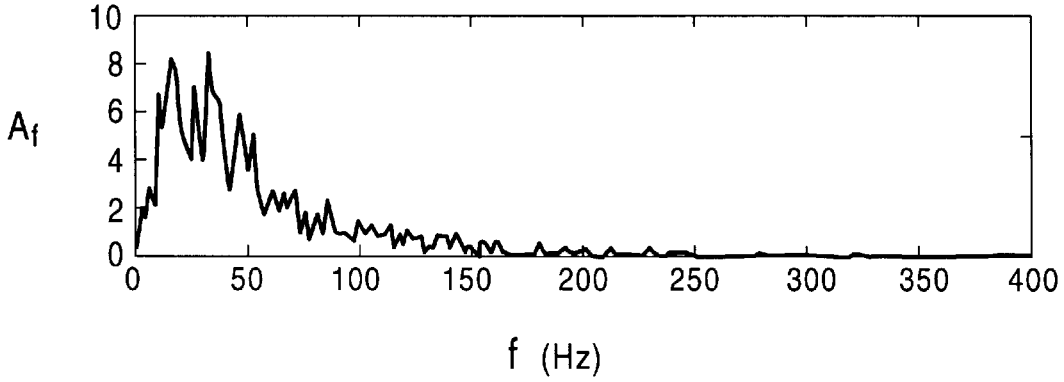
FIG. 8 is a graph showing a frequency component distribution of the acoustic signal in FIG. 7.
Figure 9:
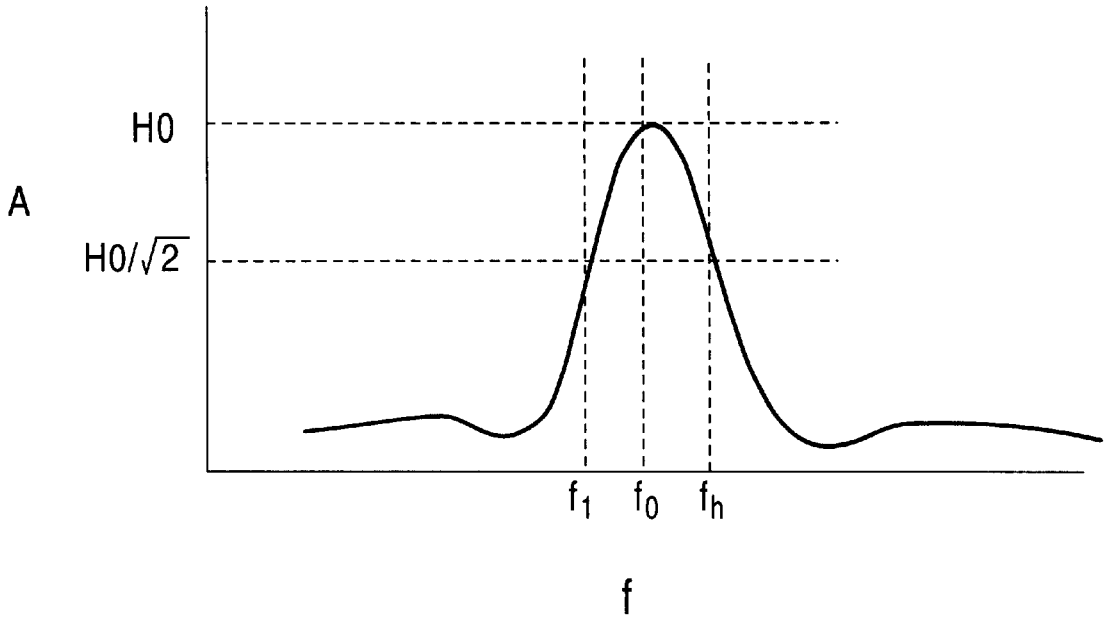
FIG. 9 is a conceptual graph of a feature of a frequency component distribution curve of an acoustic waveform.
Figure 10:
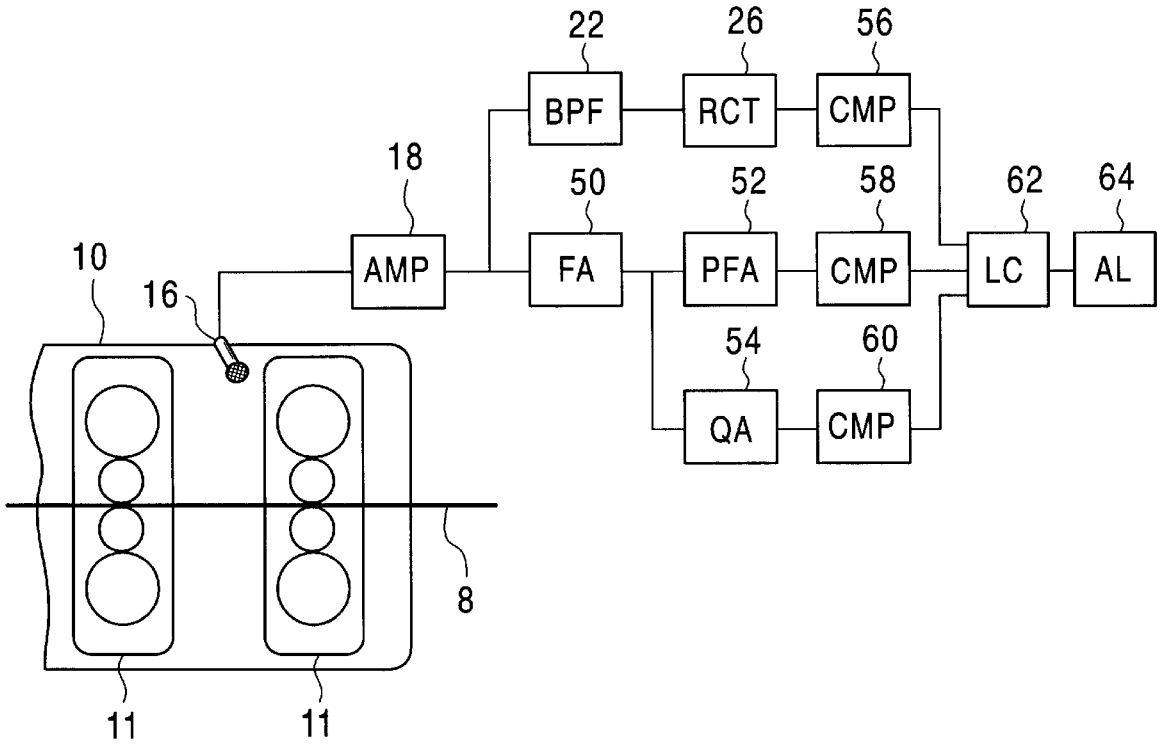
FIG. 10 is a block diagram showing a configuration of a first embodiment of a chattering detecting apparatus for a cold rolling mill in accordance with the present invention.

FIG. 10 is a block diagram showing a first embodiment of a chattering detecting apparatus for a cold rolling mill in accordance with the present invention. In FIG. 10, reference numeral 8 represents a material to be rolled, reference numeral 10 represents a tandem cold rolling mill, and reference numeral 11 represents a rolling stand. Reference numeral 16 represent an acoustic sensor detecting sound in the vicinity of a downstream stand in the rolling mill and converting it into an electrical signal, such as a microphone. Reference numeral 18 represents an amplifier circuit (AMP) amplifying an input signal so as to output an electrical signal waveform having amplitude of an adequate range. Reference numeral 22 represents band pass filter transmitting only signal components in a frequency band characteristic of chattering. Reference numeral 26 represents a rectifying circuit (RCT) inputting the output signal from the filter 22 and outputting the effective value per predetermined unit time. Reference numeral 50 represents a frequency analysis circuit (FA) calculating the frequency components of the acoustic signal. Reference numeral 52 represents a peak frequency arithmetic circuit (PFA) calculating the peak frequency of the acoustic frequency component distribution based on the output from the circuit 50. Reference numeral 54 represents a resonance factor arithmetic circuit (QA) calculating the resonance factor at the peak frequency of the acoustic frequency component distribution based on the output from the circuit 50. Reference numeral 56 represents a first comparator circuit submitting a positive signal, for example, when the effective value of the acoustic signal being the output from the circuit 26 exceeds a predetermined value. Reference numeral 58 represents a second comparator circuit submitting a positive signal, for example, when the peak frequency of the acoustic frequency component distribution being the output from the circuit 52 is within a predetermined range. Reference numeral 60 represents a third comparator circuit submitting a positive signal, for example, when the resonance factor at the peak frequency of the acoustic frequency component distribution being the output from the circuit 54 exceeds a predetermined value. Reference numeral 62 represents a logical conjunction circuit (LC) submitting an alarm signal according to the logical conjunction of the outputs from the three comparator circuits 56, 58, and 60. Reference numeral 64 represents an alarm device (AL) alarming the operator through a speaker, for example, based on the output signal from the circuit 62.

The acoustic sensor 16 detects sound in the vicinity of the rolling mill during rolling of the material 8 to be rolled and converts it into an electrical signal. The frequency characteristic of the chattering ranges from 100 to 300 Hz. Thus, as the acoustic sensor, a microphone capable of converting the sound in a frequency range of approximately 0 to 1000 Hz into an electrical signal is desirable. Use of a condenser microphone is preferred. A preferable position for installation is in the vicinity of the delivery stand of the multistage-stand cold rolling mill, because the delivery stand generally has the highest probability of the occurrence of chattering.

The amplitude circuit 18 may be a commercially available amplifier in response to the acoustic sensor 16. If the output from the acoustic sensor 16 has adequate amplitude, this circuit may be omitted.

The band pass filter 22 may be a known single circuit element or a known circuit. As the pass band thereof, a frequency range of 100 to 300 Hz is used. This range is generally known as a range containing a chattering frequency. More preferably, a mill-strip-based inherent frequency for a target rolling stand may be preliminarily measured and set.

The rectifying circuit 26 calculates and outputs the effective value per predetermined unit time of the output from the band pass filter 22. A usable rectifying method is square integration over a predetermined time interval. The rectifying circuit may be composed of a known multiplier element and a known capacitor etc. As a rectifying circuit, a peak hold circuit, which outputs the maximum amplitude of the signal within a predetermined time also can be used. As long as an output corresponds to the acoustic intensity, a signal peak within a predetermined time is also usable in addition to the square integration value. The time interval as the unit for calculating the effective value of the input waveform may be appropriately determined based on the detective response of the target chattering. The time interval is preferably 0.5 seconds or less.

The frequency analysis circuit 50 calculates and outputs the frequency components of the electrical signal, which is adjusted to an adequate voltage range in the amplitude circuit 18. In general, this may be of commercially available one, such as a spectroanalyzer or a fast Fourier transform analyzer. Alternatively, the input signal may be A/D-converted to calculate the frequency components using a digital calculator based on the known algorithm of the "fast Fourier transform (FFT)". The algorithm of the "fast Fourier transform (FFT)" is described by, for example, Oppenheim, Shafer: "Digital Signal Processing", Prentice-Hall. In the frequency analysis circuit 50, the waveform length of the frequency analysis must be set to be short within the tolerance in order to enhance the time sensitivity of the chattering detection. If the waveform length, however, is significantly short, the resolution of the frequency decreases in the detection of the peak frequency in the frequency component distribution. In the present invention, it is preferable that the waveform length is approximately 0.5 seconds.

The first comparator circuit 56 determines whether or not the output from the rectifying circuit 26 exceeds a predetermined reference value. The reference value is preferably determined based on the preliminary measurement in a rolling step without chattering. The reference value may be changed depending on the type and thickness of the material to be rolled, and the rolling speed.

The range of the peak frequency of the second comparator circuit 58 may be set to the pass band of the band pass filter 22. When the frequency inherent in the occurrence of chattering is preliminarily known, the range may be narrower than the pass band of the filter.

Next, the operation of the first embodiment will be described.

The sound occurring in the cold rolling of the material to be rolled is detected by the acoustic sensor 16, and is converted into an electrical signal. The electrical signal is amplified to a signal having amplitude within an adequate vibration in the amplitude circuit 18. The band pass filter 22 extracts only signal components of a frequency range characteristic of the chattering from the amplified signal. Next, the rectifying circuit 26 calculates and outputs the effective value of the extracted signal.

The first comparator circuit 56 outputs a positive signal if the effective value of the acoustic signal after the filtering and rectifying treatment exceeds a predetermined value.

The frequency analysis circuit 50 calculates the frequency components of the above acoustic signal at the detected time. The peak frequency arithmetic circuit 52 calculates the peak frequency of the acoustic frequency component. The resonance factor arithmetic circuit 54 calculates the resonance factor Q at the peak of the acoustic frequency component distribution.

The second comparator circuit 58 outputs a positive signal to the logical conjunction circuit 62, if $f_0$ is within a predetermined frequency range. The third comparator circuit 60 outputs a positive signal to the logical conjunction circuit 62, if the resonance factor Q exceeds a predetermined value. The alarm device 64 sounds a chattering alarm according to logical conjunction of three output signals from the first comparator circuit 56, the second comparator circuit 58, and the third comparator circuit 60.

Figure 11:
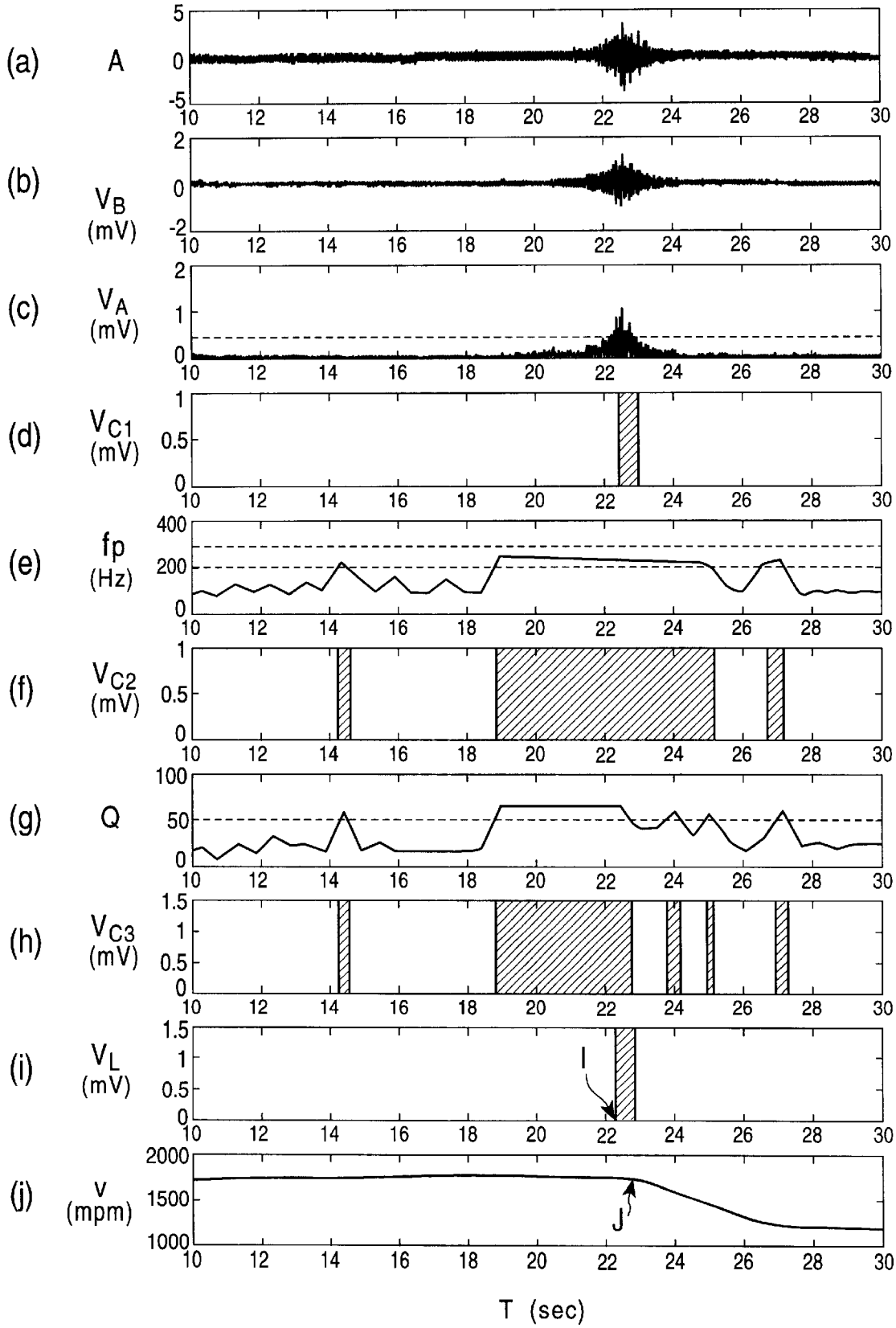
FIG. 11 includes graphs showing a measurement of time variations of outputs from individual elements of an apparatus and the rolling speed for chattering occurring in a rolling operation in the first embodiment.

FIG. 11 shows output waveforms and the like of individual elements of the apparatus in accordance with the first embodiment when chattering is detected during the rolling operation. In the drawing, FIG. 11(*a*) shows a time variation of the acoustic signal (A), FIG. 11(*b*) shows a time variation of the output ($V_B$) from the band pass filter 22, FIG. 11(*c*) shows a time variation of the output ($V_A$) from the rectifying circuit 26, FIG. 11(*d*) shows a time variation of the output ($V_{C1}$) from the first comparator circuit 56, FIG. 11(*e*) shows a time variation of the output ($f_p$) from the peak frequency arithmetic circuit 52, FIG. 11(*f*) shows a time variation of the output; ($V_{C2}$) from the second comparator circuit 58, FIG. 11(*g*) shows a time variation of the output ($Q_4$) from the resonance factor arithmetic circuit 54, FIG. 11(*h*) shows a time variation of the output ($V_{C3}$) from the third comparator circuit 60, FIG. 11(*i*) shows a time. variation of the output ($V_L$) from the logical conjunction circuit 62, and FIG. 11(*j*) shows a time variation of the rolling speed (v). In this embodiment, a conventional operation for performing line deceleration when the operator noticed the chattering was employed without the alarm operation according to the present invention. The occurrence of the output shown by arrow I in FIG. 11(*i*) and the deceleration shown by arrow J in FIG. 11(*j*) are substantially the same time. That is, in the present invention, the chattering occurring during the rolling is detected at a time which is substantially the same as the time of the chattering conventionally found by the operator.

Figure 12:
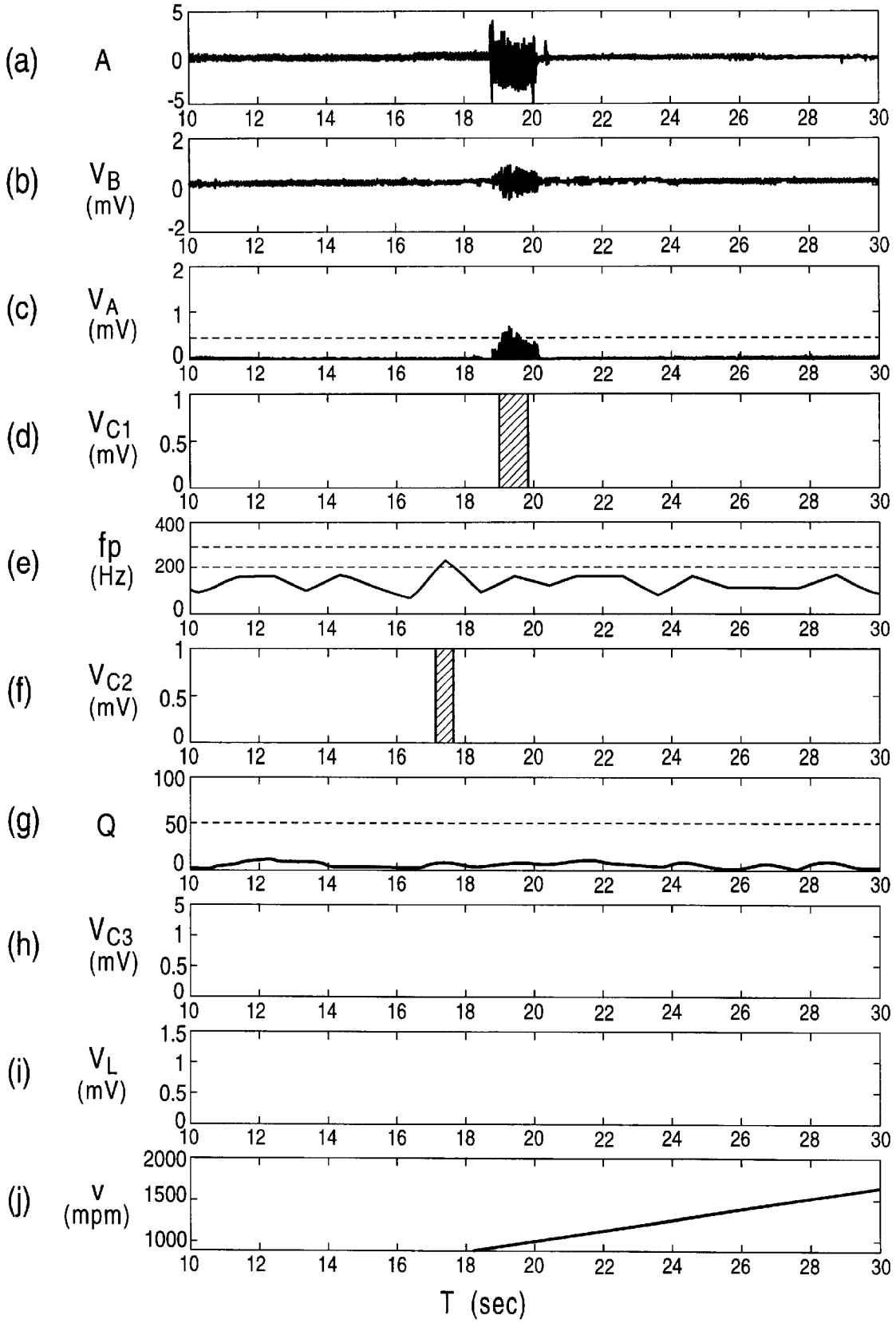
FIG. 12 includes graphs showing another measurement during the rolling operation in the first embodiment.

FIG. 12 shows another exemplary measurement according to the apparatus of the first embodiment. Symbols representing individual waveforms are the same as those in FIG. 11. In this case, no chattering is found and an impulsive sound is observed. As shown in FIG. 12(*d*), the first comparator circuit submits a positive output when only the band pass filter is employed. As shown in FIG. 12(*g*), however, the frequency range is less than the predetermined value, and no output is generated as shown in FIG. 12(*i*), so that erroneous detection is avoided.

Figure 13:
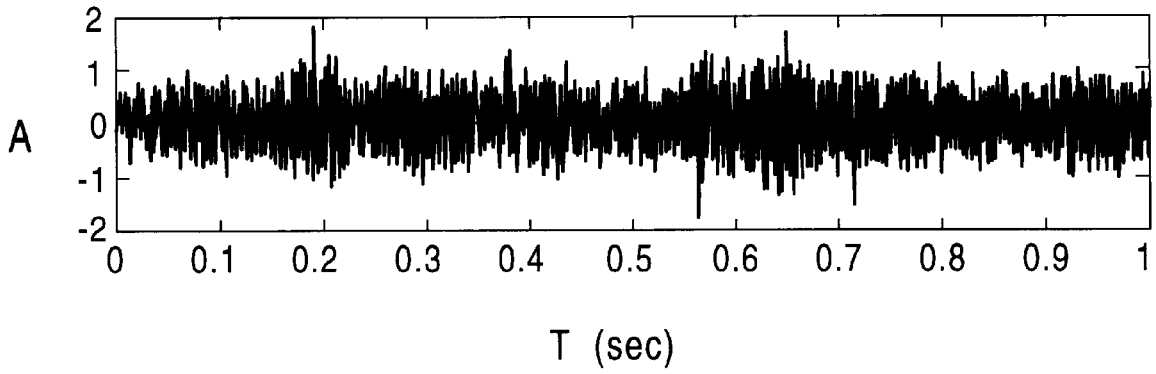
FIG. 13 is a graph showing an acoustic waveform which is misinterpreted as chattering in the first embodiment.

When the cold rolling is performed at a high speed, a sound not derived from the chattering may be observed in the vicinity of the frequencies inherent in the chattering in normal rolling without chattering. The acoustic waveform observed in this case is shown in FIG. 13. When the detection of the chattering is performed with high sensitivity based on the first embodiment, this phenomenon is erroneously detected as chattering and an alarm is sounded. The alarm may disturb the rolling operator. If automatic line deceleration is employed on the basis of the alarm, the alarm may reduce productivity. On the other hand, the threshold of the detection must be increased in order to reduce the erroneous detection. As a result, the detection of the occurrence of the chattering may be delayed, and the frequency of the strip rupture may increase.

Figure 14:
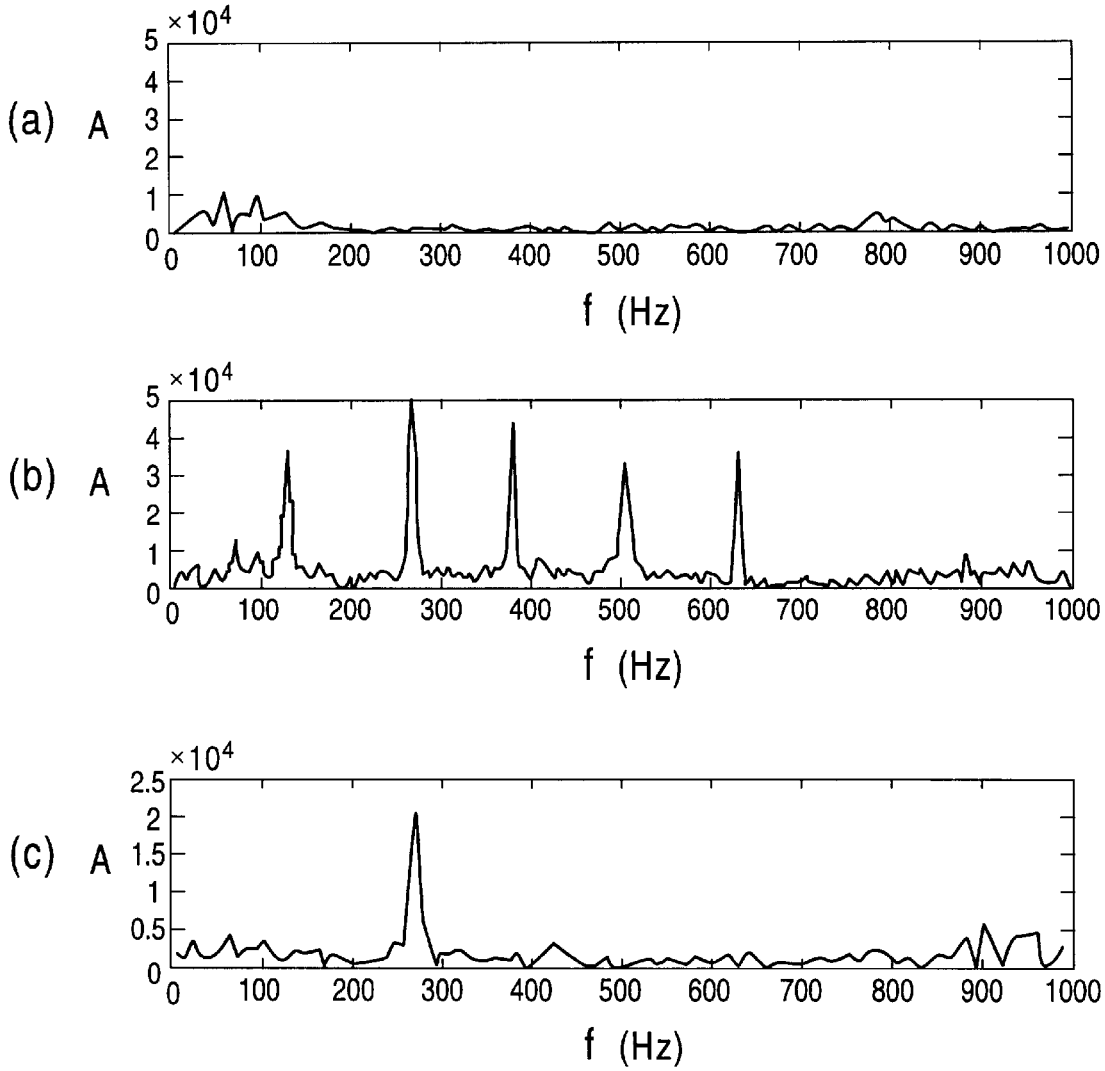
FIG. 14(*a*) shows a frequency component distribution of an acoustic waveform in the vicinity of a mill in a normal rolling state of a cold rolling mill, FIG. 14(*b*) shows a frequency component distribution of an acoustic waveform when chattering occurs during rolling, and FIG. 14(*c*) shows a frequency component distribution of an acoustic waveform when the amplitude of the acoustic waveform increases in a normal rolling state of the cold rolling mill.

The acoustic frequency component distributions of normal rolling, occurrence of chattering, and erroneous detection of the chattering in the first embodiment are shown in FIGS. 14(*a*), 14(*b*), and 14(*c*), respectively. The normal rolling shown in FIG. 14(*a*) shows the substantially uniform and random distribution over the entire frequencies. In contrast, in the occurrence of the chattering shown in FIG. 14(*b*) and the erroneous detection of the chattering shown in FIG. 14(*c*) in the first embodiment, large peaks are observed in the vicinity of certain frequencies. The acoustic frequency component distributions in the occurrence of the chattering and the erroneous detection of the chattering in the first embodiment were compared to each other, and the following facts were found. The peak frequency when the chattering is erroneously detected in the first embodiment is extremely near the second peak frequency when the chattering occurs. When the chattering is erroneously detected, a distinct single peak appears. On the other hand, a plurality of peaks occurs at a substantially equal interval with respect to the frequency when the chattering occurs.

For the correct detection of the occurrence of the chattering, a component at the inherent frequency $f_0$ of the rolling mill longitudinal vibration in the acoustic signal measured during the rolling and components at frequencies $n \cdot f_0 (n \geqq 2)$, each is an integer multiple thereof, can be used.

Thus, it is preferable that the occurrence of the chattering be detected only when every of them are large.

Practically, the judgement is performed as follows. The intensities of the acoustic signals during rolling, which passed through N band pass filters with different frequency bands as band pass ranges are set to be $V_1, V_2, \ldots$, and $V_N$. An evaluation function based on these N input parameters is set to determine the chattering in response to the outputs thereof.

For example, the evaluation function $J_1$ is set as follows in order to sound an alarm when all the components of N frequency bands exceed a predetermined value:

$$J_1 1(\text{when } V_1>V_{01},\ V_2>V_{02}, \ldots, \text{ and } V_N>V_{ON}) \quad (2)$$

$$J_1=0(\text{otherwise}) \quad (2)'$$

where $V_{01}, V_{02}, \ldots$, and $V_{ON}$ are threshold values.

This evaluation function is so-called "logical conjunction of the threshold value determinations". Alternatively, the sum ($J_2$), the product ($J'_2$), or the square sum ($J_{"2}$) thereof may be used.

$$J_2=(V_1/V_{01})+(V_2/V_{02})+\ldots+(V_N/V_{ON}) \quad (3)$$

$$J'_2=(V_1/V_{01})\cdot(V_2/V_{02})\cdot\ldots\cdot(V_N/V_{ON}) \quad (4)$$

$$J''_2=(V_1/V_{01})^2+(V_2/V_{02})^2+\ldots+(V_N/V_{ON})^2 \quad (5)$$

In a certain state of the rolling mill line, many impulsive noises with wide frequency band may be detected. In this case, the filter outputs of these bands will increase, resulting in erroneous detection of the chattering. As a countermeasure therefor, a step for determining whether or not the acoustic frequency component distribution truly includes a peak and reflects a resonance phenomenon may be added. That is, the peak frequency $f_i$ in each frequency band in the acoustic frequency component distribution and the resonance factor $Q_i$ are calculated and $V'_i$ given by the following equations may be used instead of the above $V_i$.

$$r_f(\text{i})=1 \text{ (when } f_i\epsilon[f_{1i}, f_{2i}]) \quad (6)$$

$$r_f(\text{i})=0 \text{ (otherwise)} \quad (6)'$$

$$r_Q(\text{i})=1 \text{ (when } Q_1>Q_2) \quad (7)$$

$$r_Q(\text{i})=0 \text{ (otherwise)} \quad (7)'$$

$$V'_i=V_i{}^*r_f(\text{i})^*r_Q(\text{i}) \quad (8)$$

$$\text{wherein i=1, 2, 3, } \ldots, \text{ N} \quad (9)$$

Next, a second embodiment of the present invention in consideration of the above-described method will be described in detail. This corresponds to a modification of the first embodiment.

Figure 15:
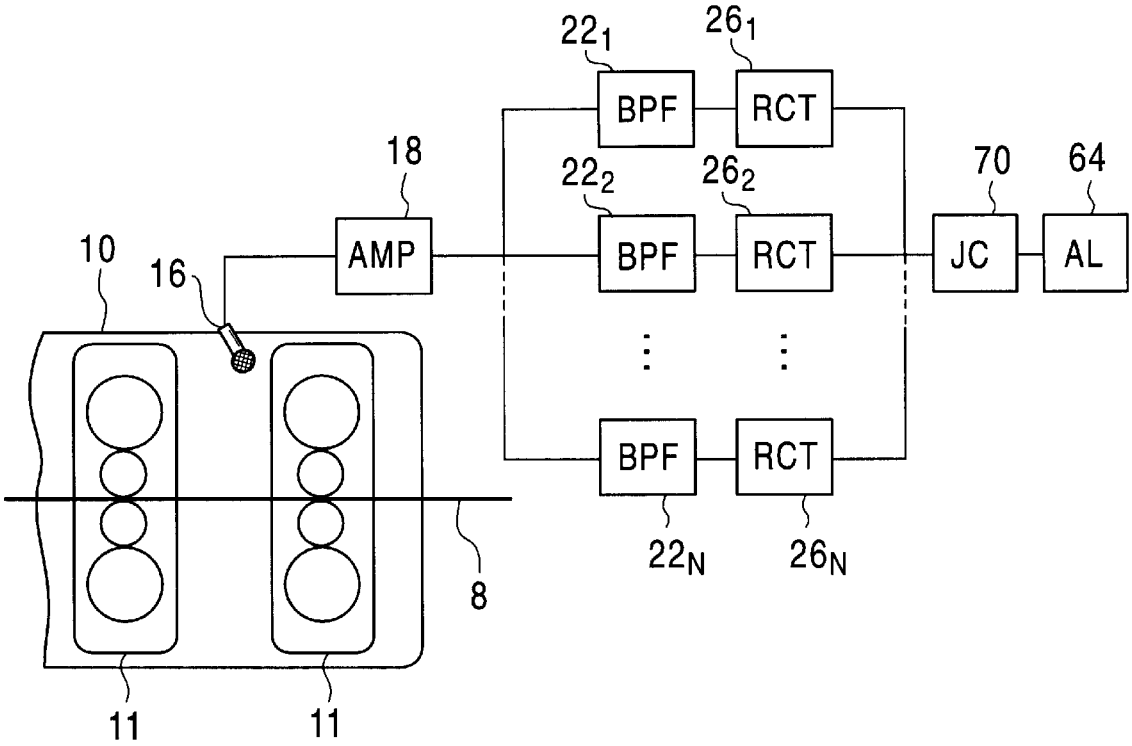
FIG. 15 is a block diagram of a configuration of a second embodiment of the chattering detecting apparatus in accordance with the present invention.

A configuration of the second embodiment of the chattering detecting apparatus for the cold rolling mill according to the present invention is shown in FIG. 15. In FIG. 15, reference numeral 8 represents a material to be rolled, reference numeral 10 represents a tandem cold rolling mill, reference numeral 16 represents an acoustic sensor, and reference numeral 18 represents an amplifying circuit. Reference numerals $\mathbf{22}_1, \mathbf{22}_2, \ldots \mathbf{22}_N$ represent first, second . . . N-th band pass filters, respectively. Reference numerals $\mathbf{26}_1, \mathbf{26}_2, \ldots \mathbf{26}_N$ represent first, second, . . . N-th rectifying circuits, respectively. Reference numeral 70 represents a judging circuit (JC) and reference numeral 64 represents an alarm device.

Herein, N, which represents the number of the band pass filters or the rectifying circuits and the number input to the judging circuits, corresponds to the number of the harmonic components of the monitored chattering. The preferable number of N may be determined depending on the number of the chattering vibration mode which can be precisely detected at the site, expenditure due to erroneous judgement and missed judgement, and operational expenditure for setting the threshold value.

Since generality is maintained when N=2, the following description is a case of N=2.

In this embodiment, the acoustic sensor 16 converts a sound over a frequency band including a frequency of at most 1,000 Hz inherent in the chattering and several higher harmonic frequencies into an electrical signal.

As the pass bands for the band pass filters $\mathbf{22}_1$ and $\mathbf{22}_2$, as described above, two different frequencies may be selected among frequencies which are an integer multiple of the fundamental frequency of the chattering. Alternatively, the preliminarily measured inherent frequency of a mill strip system in the target rolling stand may be preferably set.

The above rectifying circuits $\mathbf{26}_1$ and $\mathbf{26}_2$ calculate the effective values of the outputs from the two band pass filters $\mathbf{22}_1$ and $\mathbf{22}_2$ per predetermined unit time.

The above judging circuit 70 is a comparator circuit for judging the occurrence of the chattering from the signals calculated as above. The reference value thereof is preferably determined based on a measurement in a rolling without occurrence of chattering. The set value may be changed depending on the type and the thickness of the material to be rolled and the rolling speed.

Other features are the same as those in the first embodiment. The same reference numbers are allocated without description.

The operation of the second embodiment will now be described.

Figure 16:
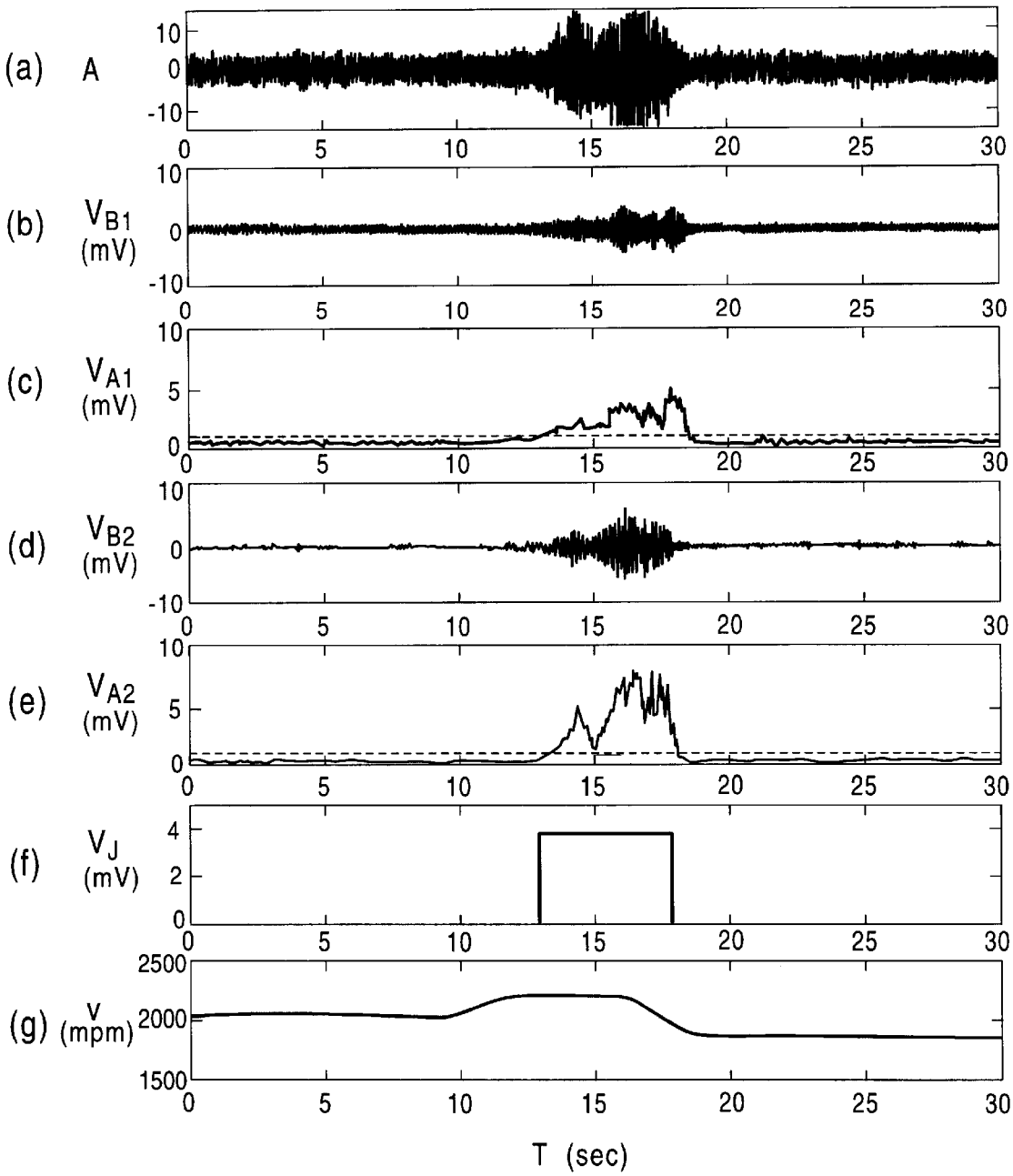
FIG. 16 includes graphs showing a measurement of time variations of outputs from individual elements of an apparatus and the rolling speed for chattering occurring in a rolling operation in the second embodiment.

FIG. 16 shows output waveforms etc. from individual devices in the second embodiment when the chattering is detected during the rolling operation. In the drawing, FIG. 16(*a*) shows a time variation of the acoustic signal (A) of the output from the acoustic sensor 16, FIGS. 16(*b*) and 16(*d*) show time variations of outputs ($V_{B1}$ and $V_{B2}$) from the first and second band pass filters $\mathbf{22}_1$ and $\mathbf{22}_2$, respectively, FIGS. 16(*c*) and 16(*e*) show time variations of outputs ($V_{A1}$ and $V_{A2}$) from the first and second rectifying circuits $\mathbf{26}_1$ and $\mathbf{26}_2$, respectively, FIG. 16(*f*) is a time variation of the output ($V_j$) from the judging circuit 70, and FIG. 16(*g*) shows a time variation of the rolling speed (v) during the operation. In this embodiment, a conventional operation for performing line deceleration when the operator found the chattering was employed without the alarm operation according to the present invention. The occurrence of the output shown in FIG. 16(*f*) and the deceleration shown in FIG. 16(*g*) are substantially the same time. That is, in the present invention, the chattering occurring during the rolling step is detected at a time which is substantially the same as the time of the chattering conventionally found by the operator.

Figure 17:
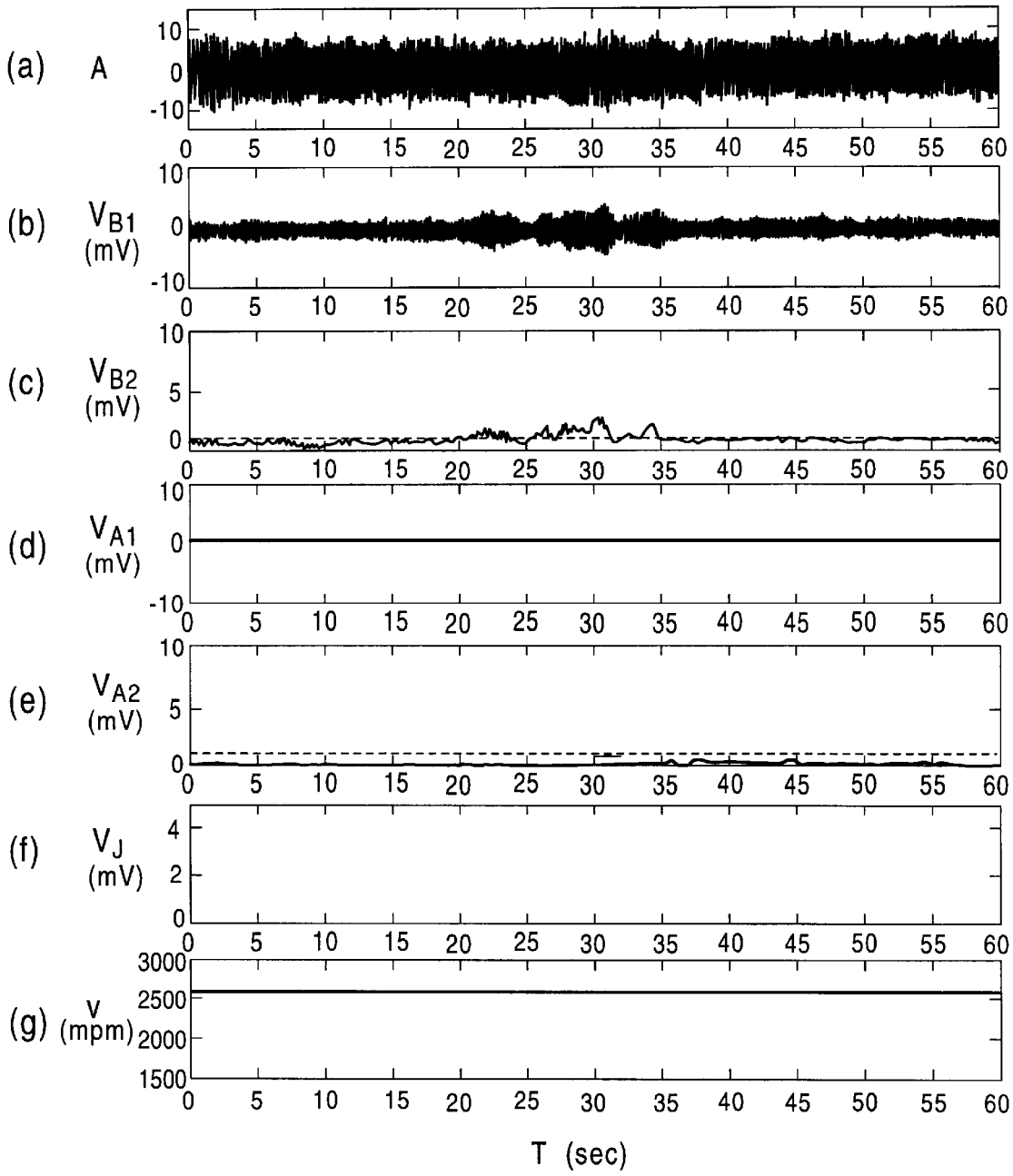
FIG. 17 includes graphs showing a measurement of time variations of outputs from individual elements of an apparatus and the rolling speed when the amplitude of the acoustic waveform increases regardless of no chattering occurrence in a rolling operation of a material in the second embodiment.

FIG. 17 shows another exemplary measurement according to the apparatus of the second embodiment without the occurrence of the chattering. Symbols representing individual waveforms are the same as those in FIG. 16. In this case, the amplitude of the acoustic signal increases due to noise other than chattering to the same extent as that when chattering occurs. As shown in FIG. 17(*b*), the output of the first band pass filter $\mathbf{22}_1$ also increases. As shown in FIG. 17(*d*), however, the output of the band pass filter $\mathbf{22}_2$ is small. As a result, no judgement output is generated and the erroneous detection is avoided.

A third embodiment of the present invention will now be described in detail. This corresponds to a modification the first embodiment.

Figure 18:
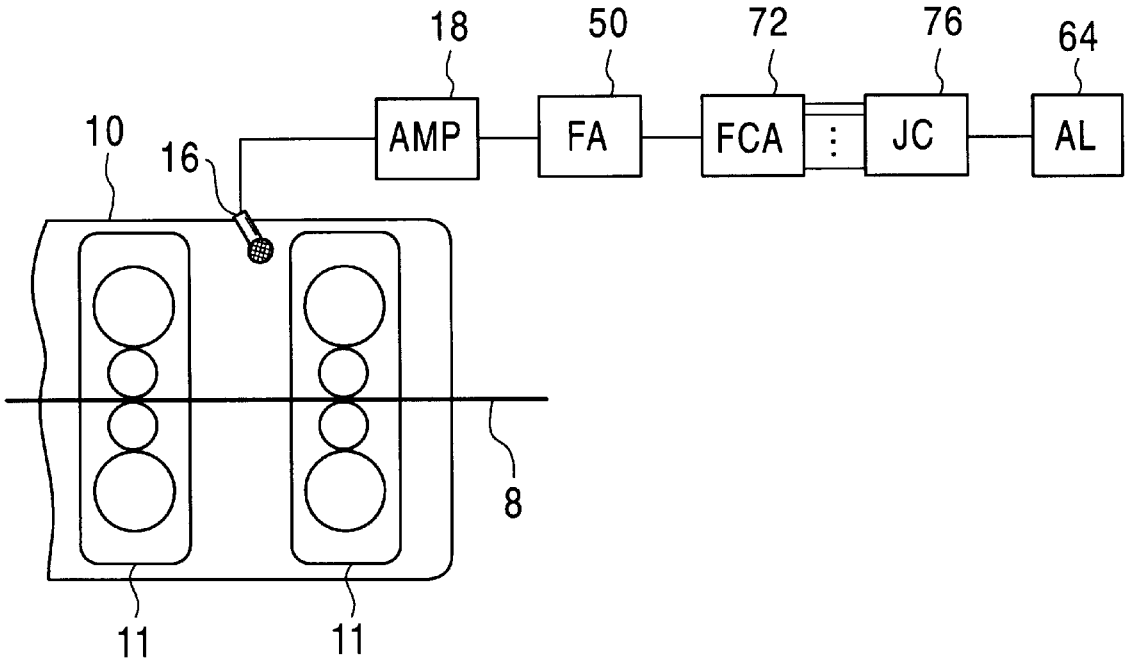
FIG. 18 is a block diagram of a configuration of a third embodiment of the chattering detecting apparatus in accordance with the present invention.

FIG. 18 is a block diagram of a configuration of a third embodiment of the chattering detecting apparatus in accordance with the present invention. In FIG. 18, reference numeral 16 represents an acoustic sensor, which is similar to that in the first and the second embodiment, and reference numeral 18 represents an amplifying circuit similar to that in the first and second embodiments. Reference numeral 50 represents a frequency analysis circuit similar to that in the first embodiment, reference numeral 72 represents a frequency component arithmetic device (FCA), and reference numeral 76 represents a judging circuit. Reference numeral 64 represents an alarm device similar to that in the first and second embodiment.

The frequency analysis circuit 50 calculates and outputs the frequency components of the electrical signal, which is adjusted to an adequate voltage range in the amplitude circuit 18.

The frequency component arithmetic device 72 calculates and outputs signal intensities from the inherent frequency of the chattering and from N frequency components, which are selected from higher harmonic modes, in the frequency components of the acoustic signal calculated by the frequency analysis circuit 50. The preferable number N for calculation is the same as that in the second embodiment. A case of N=2 will be described below. According to the observation by the present inventors, however, a slight increase/decrease of the frequency peak when the chattering occurs is confirmed. Thus, it is preferable that a tolerance Δn of approximately 10% be provided with respect to each mode frequency $f_n$ and the maximum of the frequency components of the signal intensities at the frequency range $[f_n-\Delta_n/2, f_n+\Delta_n/2]$ within a predetermined time interval is calculated as a signal intensity. Alternatively, the square mean of the signal frequency components at each frequency range may be calculated for use as a signal intensity.

The operation of the third embodiment will now be described.

Figure 19:
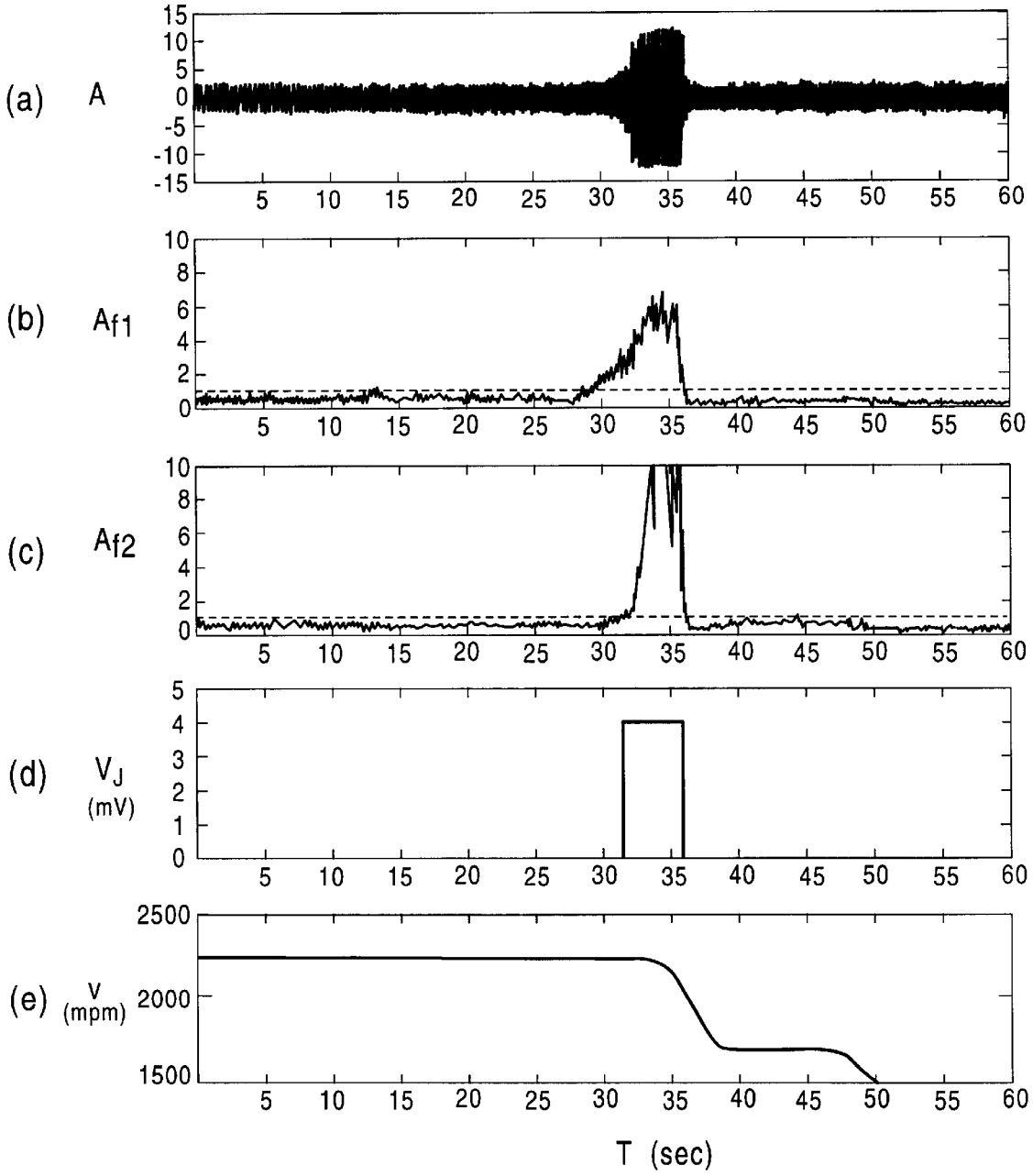
FIG. 19 includes graphs showing a measurement of time variations of outputs from individual elements of an apparatus and the rolling speed for chattering occurring in a rolling operation in the third embodiment.

FIG. 19 shows output waveforms etc. from individual devices in the third embodiment when the chattering is detected during the rolling operation. In the drawing, FIG. 19(*a*) shows a time variation of the acoustic signal (A) of the output from the acoustic sensor 16, FIGS. 19(*b*) and 19(*c*) show time variations of acoustic intensities ($A_{f1}$ and $A_{f2}$) from the first and second frequency ranges from the frequency component arithmetic device 72, FIGS. 19(*d*) shows a time variation of outputs ($V_J$) from the judging circuit; 76, and FIG. 19(*e*) shows a time variation of the rolling speed (v) during the operation. In accordance with the present invention, the chattering occurring during the rolling step is detected at a time which is substantially the same as the time of the chattering conventionally found by the operator.

A fourth embodiment of the present invention will now be described in detail.

Figure 20:
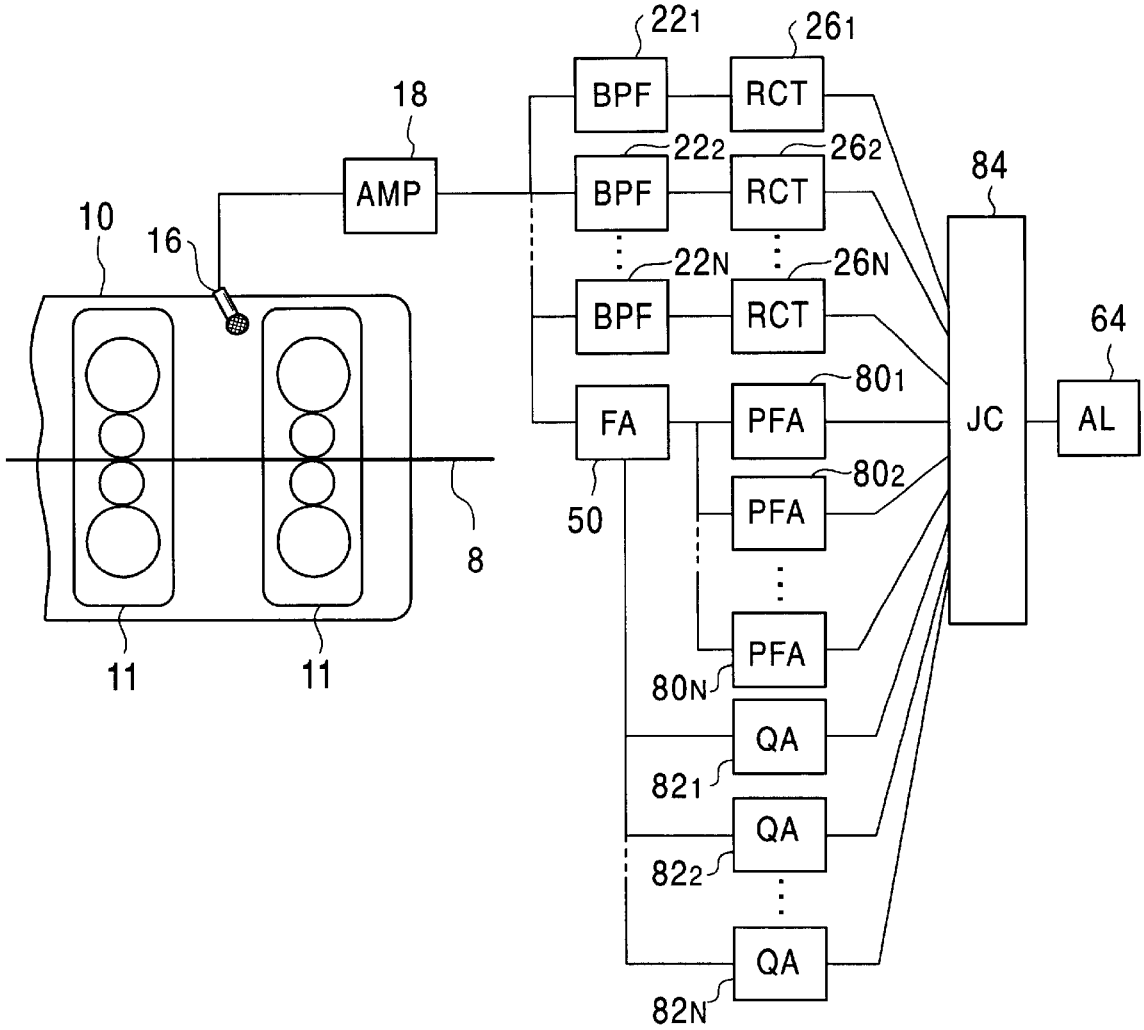
FIG. 20 is a block diagram of a configuration of a fourth embodiment of the chattering detecting apparatus in accordance with the present invention.

FIG. 20 is a block diagram of a configuration of a fourth embodiment of the chattering detecting apparatus in accordance with the present invention. In FIG. 20, reference numeral 10 represents a tandem cold rolling mill, reference numeral 16 represents an acoustic sensor, reference numeral 18 represents an amplifying circuit, reference numerals $\mathbf{22}_1$, $\mathbf{22}_2$, . . . $\mathbf{22}_N$ represent first, second, . . . N-th band pass filters, respectively, and reference numerals $\mathbf{26}_1$, $\mathbf{26}_2$, . . . $\mathbf{26}_N$ represent first, second, . . . N-th rectifying circuits, respectively. Reference numeral 50 represents a frequency analysis circuit similar to that in the first and second embodiments. Reference numerals $\mathbf{80}_1$, $\mathbf{80}_2$, . . . $8O_N$ represent first, second, . . . N-th peak frequency arithmetic circuits, respectively, reference numerals $\mathbf{82}_1$, $\mathbf{82}_2$, . . . $\mathbf{82}_N$ represent first, second, . . . N-th resonance factor arithmetic circuits (QA), respectively, reference numeral 84 represents a judging circuit, and reference numeral 64 represents an alarm device. A peak hold circuit may be used as the rectifying circuit.

The first, second, . . . N-th peak frequency arithmetic circuits $\mathbf{80}_1$, $\mathbf{80}_2$, . . . $\mathbf{80}_N$ are arithmetic circuits, which calculate a peak frequency in a predetermined frequency range using the output from the frequency analysis circuit 50. These frequency ranges may be the same as the pass bands of the first, second, . . . N-th band pass filters $\mathbf{22}_1$, $\mathbf{22}_2$, . . . $\mathbf{22}_N$. When the range of the peak frequencies inherent in the occurrence of the chattering is previously known, these ranges may be narrower.

The first, second, . . . N-th resonance factor arithmetic circuits $\mathbf{82}_1$, $\mathbf{82}_2$, . . . $\mathbf{82}_N$ calculate resonance factors $Q_1$, $Q_2$, $Q_N$, respectively, at the corresponding peak frequencies.

The judging circuit 84 is an arithmetic circuit, which sounds an alarm output when the value of the evaluation function exceeds a predetermined threshold value in which the evaluation function is calculated based on the outputs of rectifying circuits $\mathbf{26}_1$, $\mathbf{26}_2$, . . . $\mathbf{26}_N$ the peak frequency in each band, and the resonance factor of each peak frequency.

In this embodiment, the preferable number N for the band pass filters, rectifying circuits, peak frequency arithmetic circuits, and resonance factor arithmetic circuits may also be determined depending on the number of the chattering vibration mode which can be precisely detected at the site, and operational expenditure. The following description is a case of N=2.

The operation of the fourth embodiment will now be described.

Figure 21:
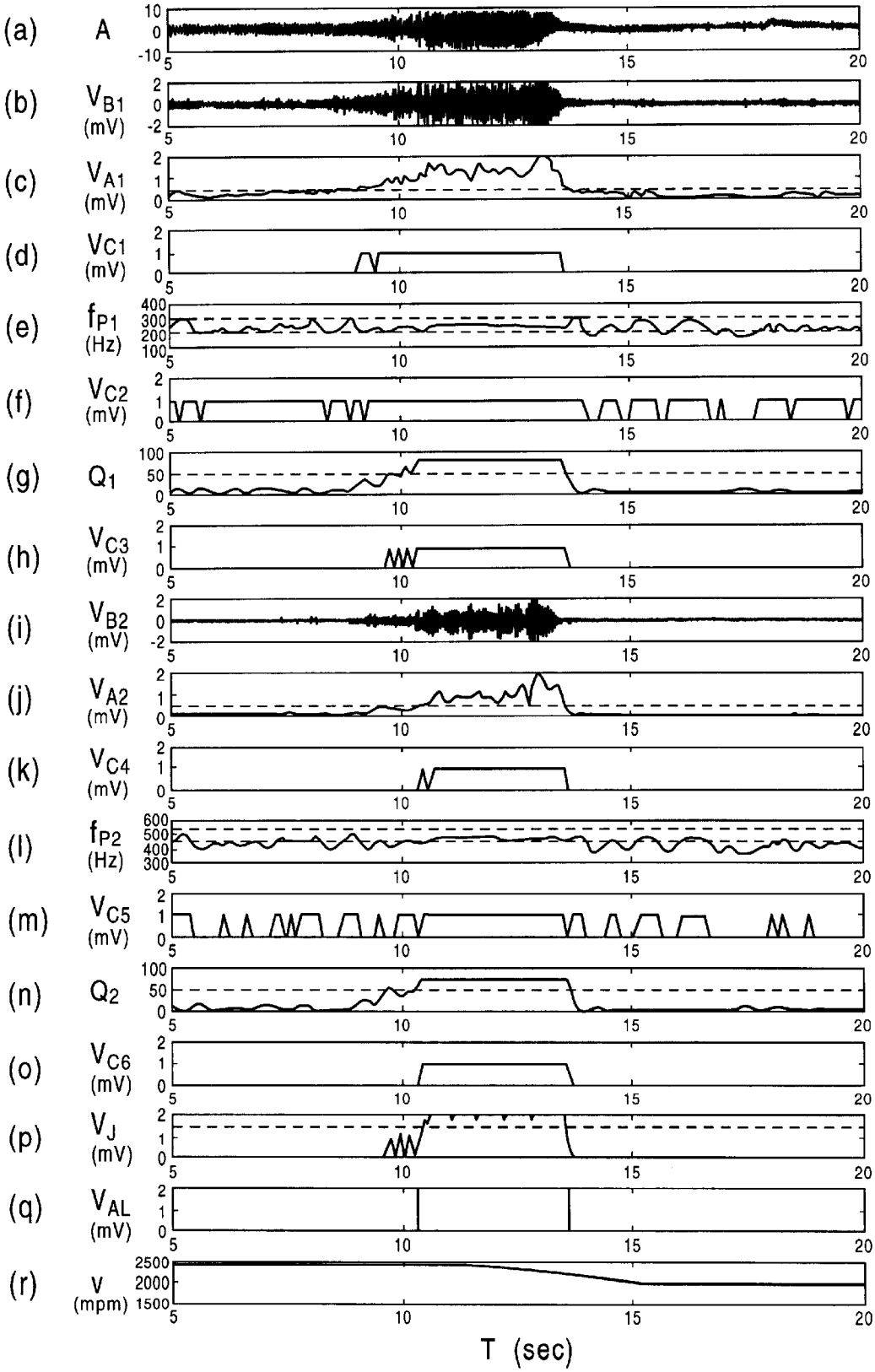
FIG. 21 includes graphs showing a measurement of time variations of outputs from individual elements of an apparatus and the rolling speed for chattering occurring in a rolling operation in the fourth embodiment.

FIG. 21 shows output waveforms etc. from individual devices in the fourth embodiment when the chattering is detected during the rolling operation. In the drawing, FIG. 21(*a*) shows a time variation of the acoustic signal (A) of the output from the acoustic sensor 16, FIGS. 21(*b*) and 21(*i*) show time variations of outputs ($V_{B1}$ and $V_{B2}$) from the first and second band pass filters $\mathbf{22}_1$ and $\mathbf{22}_2$, respectively, FIGS. 21(*c*) and 21(*j*) show time variations of outputs ($V_{A1}$ and $V_{A2}$) from the first and second rectifying circuits $\mathbf{26}_1$ and $\mathbf{26}_2$, respectively, FIGS. 21(*e*) and 21(*l*) show time variations of outputs ($f_{P1}$ and $f_{P2}$) from the first and second peak frequency arithmetic circuits $\mathbf{80}_1$ and $\mathbf{80}_2$, respectively, FIGS. 21(*g*) and 21(*n*) show time variations of outputs ($Q_1$ and $Q_2$) from the first and second resonance factor arithmetic circuits $\mathbf{82}_1$ and $\mathbf{82}_2$, respectively, and FIG. 21(*p*) is a time variation of the value ($V_J$) of the evaluation function calculated in the judging circuit 84. FIGS. 16(*d*), 16(*f*), 16(*h*), 16(*k*), 16(*m*), and 16(*o*) show time variations of the outputs ($V_{C1}$, to $V_{C6}$) of the first to sixth comparator circuits, respectively, for the convenience of the description. FIG. 21(*q*) shows a time variation of the chattering alarm output ($V_{AL}$), and FIG. 21(*r*) shows a time variation of the rolling speed (v) of the rolling line.

In this embodiment, a conventional operation for performing line deceleration when the operator found the chattering was employed without the alarm operation according to the present invention. The occurrence of the alarm output shown in FIG. 21(*q*) is several seconds earlier than the deceleration shown in FIG. 21(*r*). That is, in the present invention, the chattering occurring during the rolling step is detected at a time which is several seconds earlier than the time of the chattering conventionally found by the operator.

Figure 22:
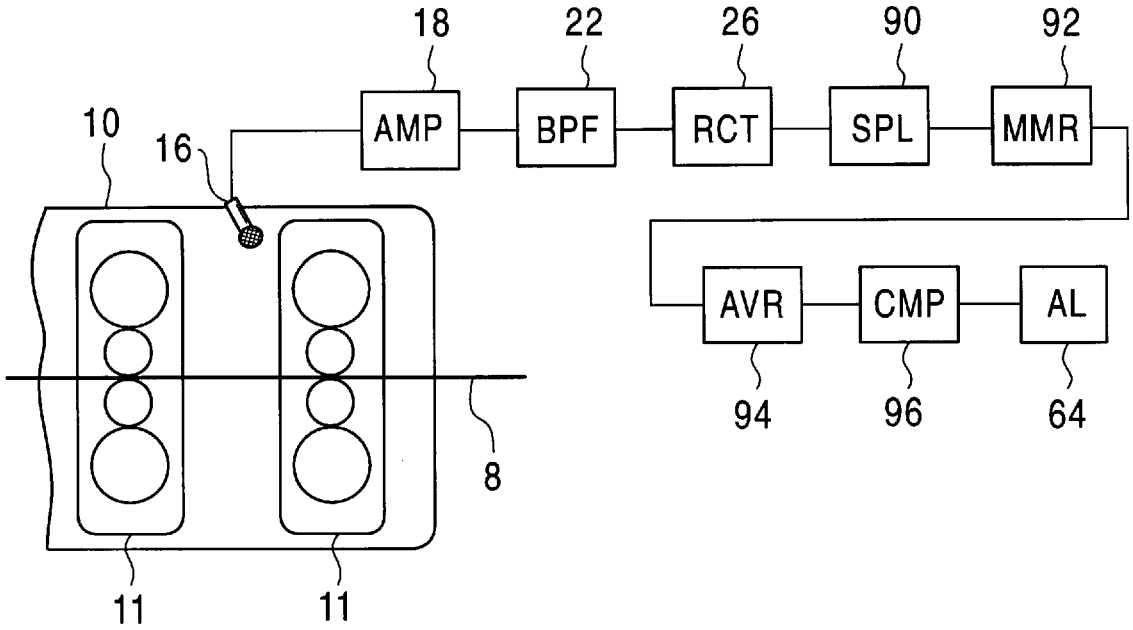
FIG. 22 is a block diagram of a configuration of a fifth embodiment of the chattering detecting apparatus in accordance with the present invention.

A fifth embodiment of the present invention will now be described in detail. In FIG. 22, reference numeral 10 represents a tandem cold rolling mill, reference numeral 11 represents a mill stand in the cold rolling mill group, and reference numeral 16 represents an acoustic sensor which is similar to that in the above embodiments. Reference numeral 18 represents an amplifying circuit, reference numeral 22 represents a band pass filter, reference numeral 26 represents a rectifying circuit, reference numeral 64 represents an alarm device, and these are similar to those in the above embodiments. Reference numeral 90 represents a sampling circuit (SPL), reference numeral 92 represents a memory circuit (MMR), reference numeral 94 represents a geometric average arithmetic circuit (AVR), and reference numeral 96 represents a comparator circuit. A peak hold circuit may be used as the rectifying circuit.

In the rectifying circuit 26, the time interval as the integration unit is preferably 0.1 seconds or less. When the peak hold circuit is used as the rectifying circuit, the time interval as the maximum detection unit is also preferably 0.1 seconds or less.

The sampling circuit 90 samples the output from the rectifying circuit 26 at a predetermined time interval ($\Delta T$). A peak hold circuit is generally used. A method for converting into digital values using an A/D converter may be employed. In general, as the $\Delta T$ value decreases, the measurement can be more precisely achieved. It is preferable that the $\Delta T$ value be the same as the time interval for calculation in the rectifying circuit.

The memory circuit 92 stores N outputs from the sampling circuit 90 in the order from newest one in synchronization with the conversion timing of the sampling circuit 90. The number N of the outputs may be determined in consideration of the right balance between the suppression of the erroneous detection and the response delay. It is preferable that N be approximately 4, and it is more preferable that the optimum be determined based on the preliminary evaluation.

The geometric average arithmetic circuit 94 calculates the geometric average of the values stored in individual stages of the memory circuit 92. That is, the geometric average ($V_N$) is calculated based on the values $V_i$ (i=0, 1, . . . N−1) stored in the individual stages of the memory circuit 92 as follows:

$$< V_N > = \left( \prod_{i=0}^{N-1} V_i \right)^{1/N} \tag{10}$$

wherein i=0 represents a current value and i=1 represents a value prior to an arithmetic frame.

The comparator circuit 96 determines whether or not the output from the geometric average arithmetic circuit 94 exceeds a predetermined reference value. This reference value is preferably determined by a measurement in a rolling step without chattering. The reference value may be changed depending on the type and the thickness of the material to be rolled, and the rolling speed.

The operation of the fifth embodiment will now be described.

Figure 23:
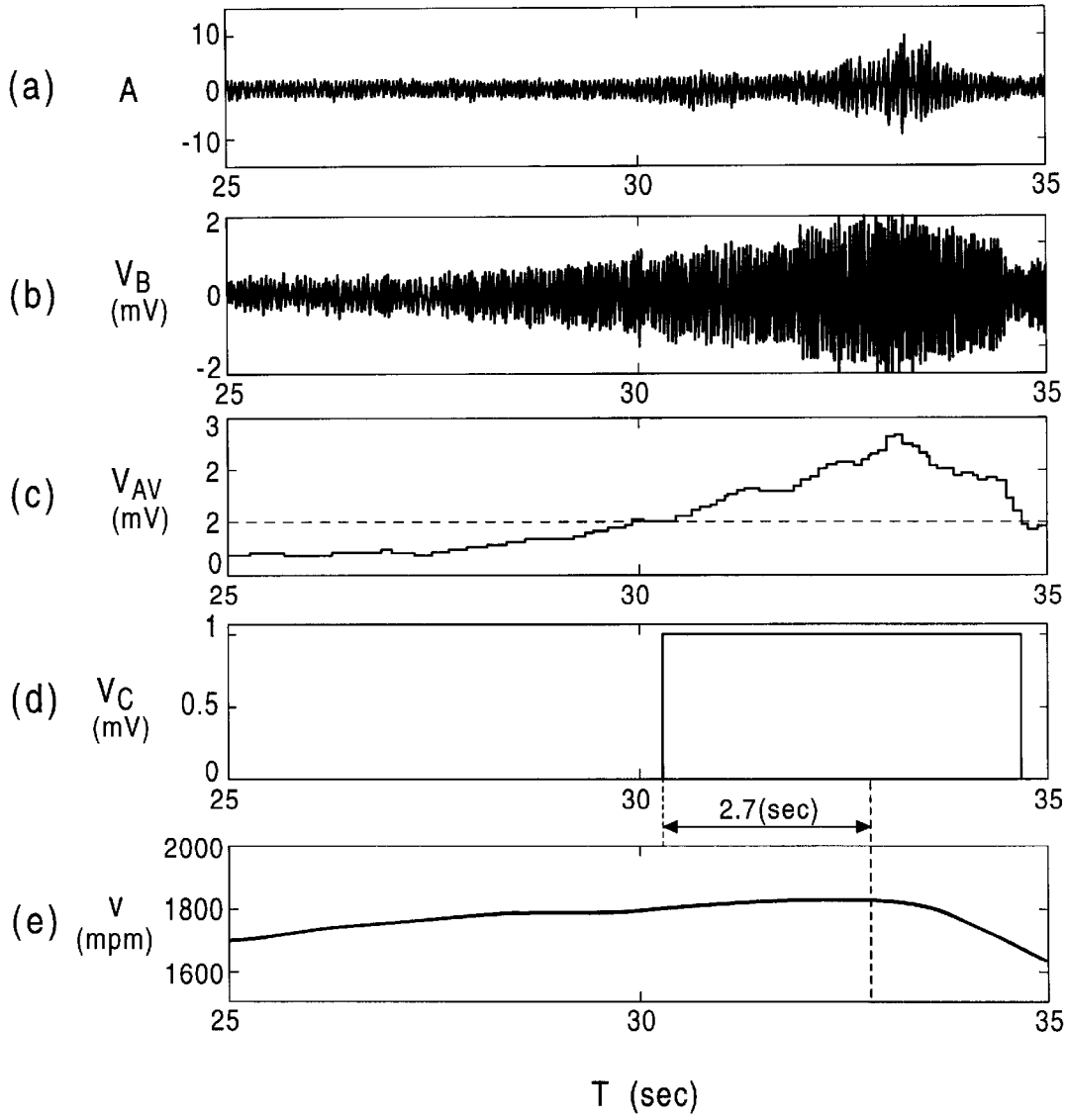
FIG. 23 includes graphs showing a measurement of time variations of outputs from individual elements of an apparatus and the rolling speed for chattering occurring in a rolling operation in the fifth embodiment.

FIG. 23 shows output waveforms etc. from individual devices in the fifth embodiment when the chattering is detected during the rolling operation. In the drawing, FIG. 23(*a*) shows a time variation of the acoustic signal (A) of the output from the acoustic sensor 16, FIG. 23(*b*) shows a time variation of the output ($V_B$) from the band pass filter 22, FIG. 23(*c*) shows a time variation of the geometric average ($V_{AV}$) of the outputs from the geometric average arithmetic circuit 94, FIG. 23(*d*) shows a time variation of the output ($V_C$) from the comparator circuit 96, and FIG. 23(*e*) shows a time variation of the rolling speed (v).

In this embodiment, a conventional operation for performing line deceleration when the operator found the chattering was employed without the alarm operation according to the present invention. The occurrence of the output from the comparator circuit shown in FIG. 23(*d*) is 2.7 seconds earlier than the deceleration shown in FIG. 23(*e*). That is, in the present invention, the chattering occurring during the rolling step is detected at a time which is 2.7 seconds earlier than the time of the chattering conventionally found by the operator.

Figure 24:
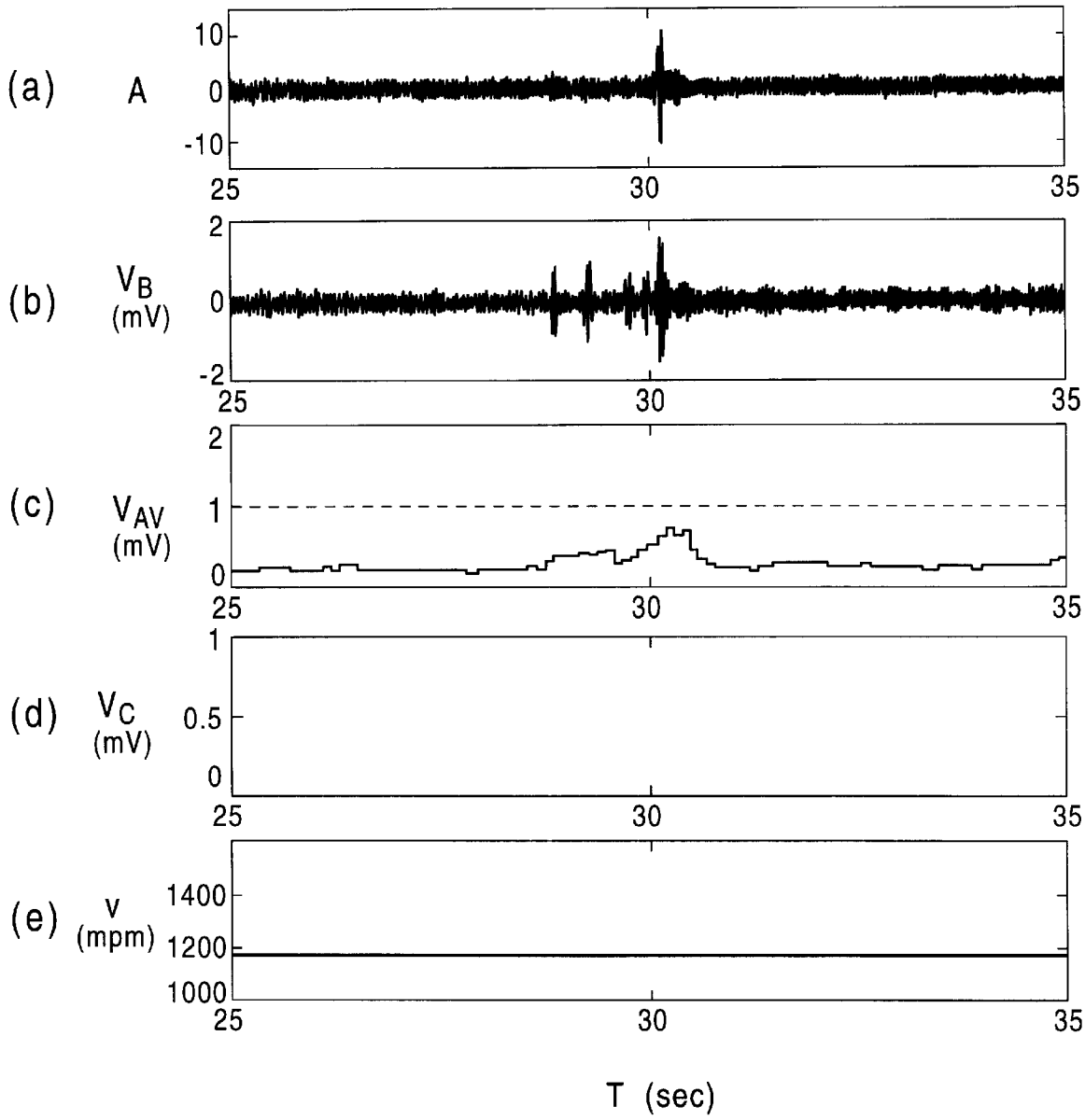
FIG. 24 includes graphs showing a measurement of the time variations of the outputs from the individual elements of the apparatus and the rolling speed when pulsed sound misinterpreted as chattering in conventional technologies occurs in the fifth embodiment.

FIG. 24 shows output waveforms etc. from individual devices in the fifth embodiment when a pulsed noise sounding an erroneous alarm in a conventional apparatus is detected during the rolling operation. Each output in FIG. 24 is similar to that in FIG. 23. The threshold values of the comparator circuit 96 in FIGS. 23 and 24 are the same. As shown in FIG. 24(*c*), the output from the geometric average arithmetic circuit 94 is small and an erroneous alarm is not sounded.

The detection ability for chattering of the apparatus of the fifth embodiment was compared to a conventional apparatus which determines the chattering using only the peak value. These were simultaneously operated without alarm actions, and the detection of the chattering was compared to the case found by the operator. The detection ability of the chattering was determined by the number of detected chattering phenomena, the number of the erroneous detection actions, and the time difference from the time found by the operator. The operation was continued until the number of the detected chattering phenomena reached 40. The erroneous detection actions were 16 in the conventional apparatus and was reduced to be 3, that is, one-fifth in this embodiment. The average time difference from the action of the detection unit to the discovery by the operator was 2.6 seconds in the fifth embodiment or 2.7 seconds in the conventional method, and there was no substantial difference. Accordingly, this embodiment verified the effects of the suppression of erroneous detection without deterioration of rapid detection of the chattering.

A sixth embodiment of the present invention will now be described in detail.

Figure 25:
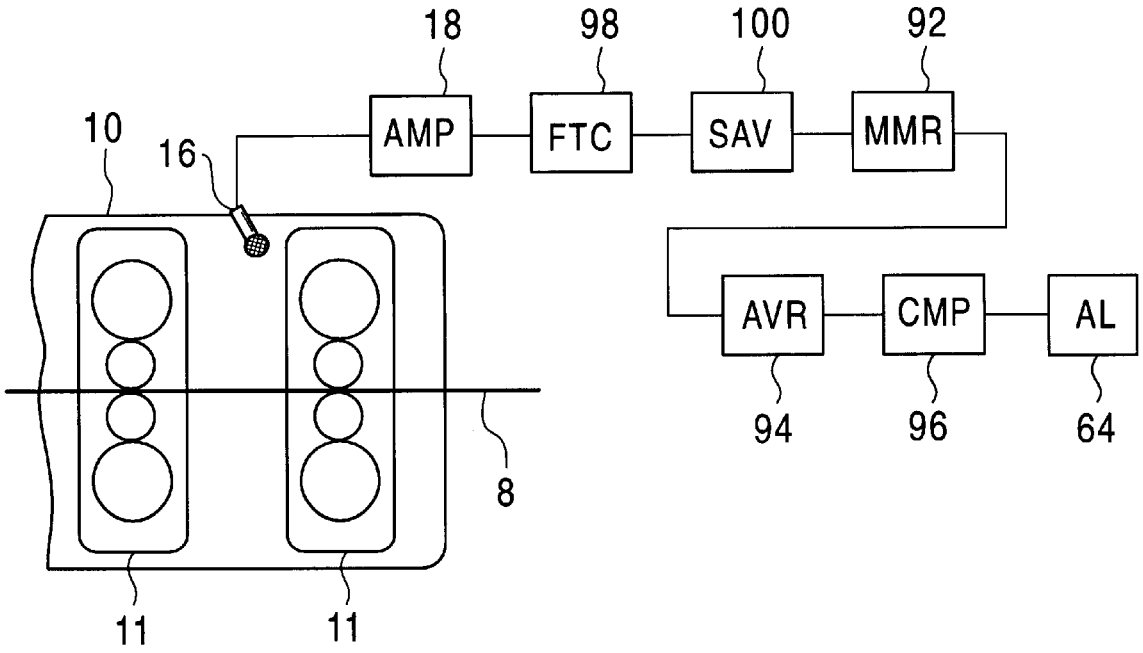
FIG. 25 is a block diagram of a configuration of a sixth embodiment of the chattering detecting apparatus in accordance with the present invention.

FIG. 25 is a block diagram of the sixth embodiment of the chattering detecting apparatus of the cold rolling mill in accordance with the present invention.

In FIG. 25, reference numeral 16 represents a acoustic sensor, reference numeral 18 represents an amplifying circuit, and reference numeral 64 represents an alarm device, these being similar to those in the above embodiments. Reference numeral 98 represents a Fourier transform circuit (FTC), reference numeral 100 represents a square average arithmetic circuit (SAV). Reference numeral 92 represents a memory circuit, reference numeral 94 represents a geometric average circuit, reference numeral 96 represents a comparator circuit, and these are similar to those in the fifth embodiment.

In the Fourier transform circuit 98, the waveform length in the frequency analysis must be shortened within the tolerance in order to enhance the temporal sensitivity of the chattering detection. When the waveform length, however, is excessively short, the frequency resolution in the frequency analysis is decreased. Thus, it is preferable that the waveform length be approximately 0.2 second in this embodiment.

The square average arithmetic circuit 100 calculates the signal intensity of a frequency component characteristic of the occurrence of the chattering among the signal frequency components calculated in the Fourier transform circuit 98.

According to the observation by the present inventors, a case of a slight change in the frequency peak when the chattering occurs is confirmed. Thus, an allowable range of Δ=approximately 10% is provided with respect to the frequency f of the chattering, and the signal intensity is calculated from the frequency components of the signal intensity in the frequency range [f−Δ/2, f+Δ/2]. In this embodiment, the square average of the frequency components of the signal intensity within the predetermined frequency range is calculated. The maximum, however, may be calculated instead of the square average. Moreover, a frequency component calculation apparatus which is similar to the third embodiment may be used instead of the square average arithmetic circuit 100.

The operation of the sixth embodiment will now be described.

Figure 26:
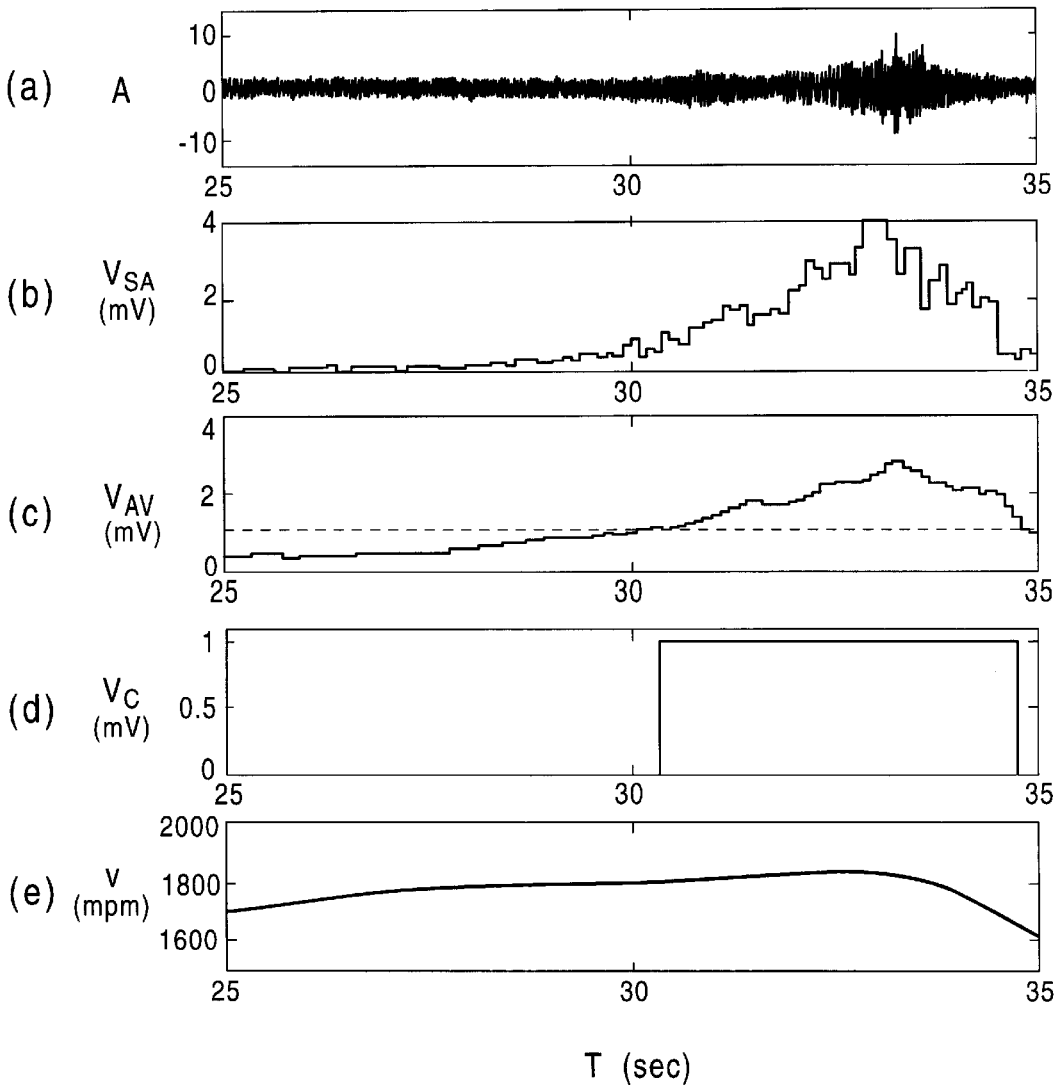
FIG. 26 includes graphs showing a measurement of time variations of outputs from individual elements of an apparatus and the rolling speed for chattering occurring in a rolling operation in the sixth embodiment.

FIG. 26 shows output waveforms etc. from individual devices in the sixth embodiment when the chattering is detected during the rolling operation. In the drawing, FIG. 26(*a*) shows a time variation of the acoustic signal (A) of the output from the acoustic sensor 16, FIG. 26(*b*) shows a time variation of the output ($V_{SA}$) from the square average arithmetic circuit 100, FIG. 26(*c*) shows a time variation of the output ($V_{AV}$) from the geometric average arithmetic circuit 94, FIG. 26(*d*) shows a time variation of the output ($V_C$) from the comparator circuit 96, and FIG. 26(*e*) shows a time variation of the rolling speed (v) during the operation. The occurrence of the output from the comparator circuit shown in FIG. 26(*d*) is substantially the same as the deceleration shown in FIG. 26(*e*). That is, in the present invention, the chattering occurring during the rolling is detected at a time which is substantially the same as the time of the chattering conventionally found by the operator.

In the above-described embodiments, the alarm device 64 may be one which calls operator's attention for decelerating the line speed by turning on an indicating lamp or making an alarm sound. Alternatively, it may be one which automatically decreases the line speed using a sequencer.

In the above-described embodiments, the band pass filter and the various arithmetic circuits, the judging circuit may be replaced by calculation circuits with respect to digital signals which are sampled at an isochronal interval. Alternatively, these circuits may be replaced with a software on a microprocessor.

INDUSTRIAL APPLICABILITY

In accordance with the present invention, the erroneous detection, which has occurred in conventional chattering detecting methods using acoustic sensors and vibration sensors, can be reduced. This erroneous detection occurs due to noise other than the rolling operation and noise due to impulsive vibration, which is applied to facility including a rolling mill and inter-stand auxiliary rolls. Since the erroneous detection is reduced, production loss, e.g., erroneously scrapping normally rolled portions of the rolled material and erroneous deceleration during the normal rolling, can be avoided.

Since the chattering can be detected without delay during the cold rolling operation, a rapid countermeasure by the operator can reduce failed portions due to chattering. Moreover, the strip rupture due to the chattering vibration can be prevented. Thus, the present invention is significantly advantageous in the production yield and operational efficiency.

The erroneous detection being the problem in the conventional methods by acoustic detection can be adequately suppressed. As a result, the operation loss due to the erroneous detection is reduced and operators feels reliability about alarms from a sensor.

The apparatus configuration is simple compared to conventional methods using vibration sensors and thicknessmeters. The use of the acoustic sensor, which is a noncontact detecting means, allows the sensor to lie at a position distant from the mill, resulting in improved sensor maintenance.

What is claimed is:

1. A method for detecting chattering of a cold rolling mill, comprising the steps of:

measuring a sound with a sensor detached from and, located in close proximity to the cold rolling mill during rolling;

deriving a plurality of acoustic parameters from the sound measured; and determining that each of the acoustic parameters are equal to, greater than, or within a range of predetermined values detecting chattering based on the derived acoustic parameters, wherein one or more of the derived acoustic parameters relate to a resonance factor or harmonic components of the chattering.

2. A method for detecting chattering of a cold rolling mill according to claim 1, wherein the acoustic parameters are an acoustic intensity of a frequency range characteristic of the occurrence of the chattering, a peak frequency in the frequency band characteristic of the occurrence of the chattering in an acoustic frequency distribution, and a resonance factor at the peak frequency, and the occurrence of the chattering is detected when these acoustic parameters range within predetermined ranges.

3. A method for detecting chattering of a cold rolling mill according to claim 1, wherein the acoustic parameters are acoustic intensities in a plurality of frequency ranges selected from the fundamental frequency inherent in the chattering and the frequencies being the products of the fundamental frequency and integers of 2 or more, and the occurrence of the chattering is detected when the acoustic parameters exceed predetermined threshold values.

4. A method for detecting chattering of a cold rolling mill according to claim 1, wherein the acoustic parameters are frequency components of acoustic intensities in frequency ranges $[f_i-\Delta_i/2, f_i+\Delta_i/2]$ with respect to a plurality of predetermined frequencies $f_i$ and band widths $\Delta_i$ (i=1, 2, 3, . . . ), and the occurrence of the chattering is detected when the acoustic parameters exceed predetermined threshold values.

5. A method for detecting chattering of a cold rolling mill according to claim 1, wherein the acoustic parameters are the acoustic intensities in a plurality of frequency ranges characteristic of the occurrence of the chattering, peak frequencies in a plurality of frequency ranges characteristic of the occurrence of the chattering in an acoustic frequency component distribution, and a resonance factor of the peak frequency, and the occurrence of the chattering is detected when the acoustic parameters exceed predetermined threshold values.

6. A method for detecting chattering of a cold rolling mill according to claim 1, wherein the acoustic parameters are acoustic intensities in frequency ranges characteristic of the chattering in the last N frames including the current detecting time (N is a predetermined integer and the frame represents an appropriate unit time), and the occurrence of the chattering is detected when the geometric average of the acoustic parameters exceeds a predetermined threshold value.

7. A method for detecting chattering of a cold rolling mill according to claim 1, wherein the acoustic parameters are frequency components of acoustic intensities in frequency ranges [f−Δ/2, f+Δ/2] with respect to a predetermined frequency f and a predetermined band width Δ of the last N frames including the current detecting time (N is a predetermined integer and the frame represents an appropriate unit time), and the occurrence of the chattering is detected when the geometric average of the square averages of the acoustic parameters exceeds a predetermined threshold value.

8. An apparatus for detecting chattering of a cold rolling mill comprising:

a sensor, that measures a sound, detached from and located in close proximity to the cold rolling mill during rolling;

a circuit that calculates and outputs a plurality of acoustic parameters from an acoustic signal output from the sensor; and a circuit that detects the occurrence of the chattering from the acoustic parameters for generating a detecting signal, wherein each of the acoustic parameters are equal to, greater than, or within a range of predetermined values, and wherein one or more of the acoustic parameters relate to a resonance factor or harmonic components of the chattering.

9. An apparatus for detecting chattering of a cold rolling mill according to claim 8, further comprising:

a microphone placed in the vicinity of the cold rolling mill;

a band pass filter inputting an electrical signal output from the microphone and outputting only a predetermined frequency range component;

a rectifying circuit for the output from the band pass filter;

a first comparator circuit for generating an output signal when the output from the rectifying circuit exceeds a predetermined value;

a frequency analysis circuit for calculating and outputting frequency components of the electrical signal output from the microphone;

a peak frequency arithmetic circuit for calculating and outputting a peak frequency of the output signal from the frequency analysis circuit;

a second comparator circuit for generating an output signal when the output from the peak frequency arithmetic circuit is within a predetermined value;

a resonance factor arithmetic circuit calculating and outputting a resonance factor in the peak frequency of the output signal from the frequency analysis circuit;

a third comparator circuit for generating an output signal when the output from the resonance factor arithmetic circuit is within a predetermined value; and an alarm device alarming the occurrence of the chattering when the output signals are submitted from all the first, second, and third comparator circuits.

10. An apparatus for detecting chattering of a cold rolling mill according to claim 8, further comprising:

a microphone placed in the vicinity of the cold rolling mill;

a plurality of band pass filters inputting electrical signals output from the microphone and outputting only a plurality of predetermined frequency range components;

a rectifying circuit for the output from each of said band pass filters;

a detection circuit for inputting the output from the rectifying circuit and outputting a chattering occurrence signal based on a predetermined equation; and an alarm device outputting an alarm of the occurrence of the chattering when the output signal from the determination circuit is input.

11. An apparatus for detecting chattering of a cold rolling mill according to claim 8, further comprising:

a microphone placed in the vicinity of the cold rolling mill;

a frequency analysis circuit for calculating and outputting frequency components of the electrical signal output from the microphone;

an arithmetic circuit for inputting the output from the frequency analysis circuit and outputting a maximum value within a predetermined time of the frequency components of the input signal intensities in a plurality of predetermined frequency ranges $[f_i-\Delta_i/2, f_i+\Delta_i/2]$ (i=1, 2, 3, . . . );

a detection circuit for outputting a chattering occurrence signal from the output from the arithmetic circuit based on a predetermined equation; and an alarm device outputting an alarm of the occurrence of the chattering when the output signal from the determination circuit is input.

12. An apparatus for detecting chattering of a cold rolling mill according to claim 8, further comprising:

a microphone placed in the vicinity of the cold rolling mill;

a frequency analysis circuit for calculating and outputting frequency components of the electrical signal output from the microphone;

an arithmetic circuit for inputting the output from the frequency analysis circuit and outputting a square average within a predetermined time of the frequency components of the input signal intensities in a plurality of predetermined frequency ranges $[f_i-\Delta_i/2, f_i+\Delta_i/2]$ (i=1, 2, 3, . . . );

a detection circuit for outputting a chattering occurrence signal from the output from the arithmetic circuit based on a predetermined equation; and an alarm device outputting an alarm of the occurrence of the chattering when the output signal from the determination circuit is input.

13. An apparatus for detecting chattering of a cold rolling mill according to claim 8, further comprising:

a microphone placed in the vicinity of the cold rolling mill;

a plurality of band pass filters inputting electrical signals output from the microphone and outputting only a plurality of predetermined frequency ranges components;

a rectifying circuit for the output from each of said band pass filters;

a frequency analysis circuit for calculating and outputting frequency components of the electrical signal output from the microphone;

a peak frequency arithmetic circuit for calculating and outputting a plurality of peak frequencies in the plurality of frequency ranges of the output signal from the frequency analysis circuit;

a resonance factor arithmetic circuit calculating and outputting resonance factors in the plurality of peak frequencies of the output signal from the frequency analysis circuit;

a detection circuit for inputting the output from the rectifying circuit, the frequency analysis circuit, and the resonance factor arithmetic circuit, and outputting a chattering occurrence signal based on a predetermined equation; and an alarm device outputting an alarm of the occurrence of the chattering when the output signal from the determination circuit is input.

14. An apparatus for detecting chattering of a cold rolling mill according to claim 8, further comprising:

an acoustic sensor placed in the vicinity of the cold rolling mill, for detecting a sound during rolling a material to be rolled and converting the sound into an electrical signal;

an amplifying circuit for amplifying the electrical signal into an electrical signal having an adequate amplitude;

a band pass filter inputting the amplified signal and outputting only a predetermined frequency band component;

a rectifying circuit for the output from the band pass filter;

a sampling circuit and a memory circuit for sampling and storing, respectively, the last N frames including the current detecting time from the output from the rectifying circuit;

a geometric average arithmetic circuit for calculating a geometric average of N values stored in the memory circuit;

a comparator circuit for submitting an output signal when the output from the geometric average arithmetic circuit exceeds a predetermined value; and an alarm device alarming of the occurrence of the chattering when the output signal is submitted from the comparator circuit.

15. An apparatus for detecting chattering of a cold rolling mill according to claim 8, further comprising:

an acoustic sensor placed in the vicinity of the cold rolling mill, for detecting a sound during rolling a material to be rolled and converting the sound into an electrical signal;

an amplifying circuit for amplifying the electrical signal into an electrical signal having an adequate amplitude;

a Fourier transform circuit for calculating and outputting signal frequency components of the amplified signal;

a square average arithmetic circuit for calculating a square average value of the signal intensity frequency components within a predetermined frequency range $[f-\Delta/2, f+\Delta/2]$ among the signal frequency components;

a memory circuit for storing the last N frames including the current detecting time in the output from the square average arithmetic circuit;

a geometric average arithmetic circuit for calculating a geometric average of the N frames stored in the memory circuit;

a comparator circuit for submitting an output signal when the value calculated by the geometric average arithmetic circuit exceeds a predetermined value; and an alarm device alarming of the occurrence of the chattering when the output signal is submitted from the comparator circuit.

* * * * *